US007032668B2

(12) United States Patent
Mondelli et al.

(10) Patent No.: US 7,032,668 B2
(45) Date of Patent: Apr. 25, 2006

(54) CEMENTING SYSTEM AND METHOD FOR WELLBORES

(75) Inventors: Juan-Carlos Mondelli, Houston, TX (US); Carlos H. Aguilera, Houston, TX (US)

(73) Assignee: BJ Services Company, Houston, TX (US)

( * ) Notice: Subject to any disclaimer, the term of this patent is extended or adjusted under 35 U.S.C. 154(b) by 0 days.

(21) Appl. No.: 10/847,597

(22) Filed: May 17, 2004

(65) Prior Publication Data

US 2004/0206500 A1 Oct. 21, 2004

Related U.S. Application Data

(62) Division of application No. 09/968,659, filed on Oct. 1, 2001, now Pat. No. 6,752,209.

(51) Int. Cl.
*E21B 33/16* (2006.01)

(52) U.S. Cl. ..... 166/291; 166/383; 166/155; 166/317; 166/318

(58) Field of Classification Search ..... 166/291, 166/383, 386, 317, 318, 325, 153, 155, 192, 166/193
See application file for complete search history.

(56) References Cited

U.S. PATENT DOCUMENTS 2,907,392 A * 10/1959 Ormsby ..... 166/325
3,860,066 A 1/1975 Pearce et al.
4,064,937 A 12/1977 Barrington (Continued)

*Primary Examiner*—David Bagnell
*Assistant Examiner*—Shane Bomar
(74) *Attorney, Agent, or Firm*—Locke Liddell & Sapp LLP

(57) ABSTRACT

The present invention provides a cementing system and method for wellbores by cementing an annulus between a wellbore casing and a wellbore. In at least one embodiment, the invention includes a landing collar defining a restricted passage, a wellbore casing defining a passage coupled to the landing collar, a top cementing plug for sealingly engaging the wellbore casing, a bottom cementing plug for sealingly engaging the wellbore casing, and a fluid injection assembly coupled to the wellbore casing for injecting fluidic materials into the wellbore casing and controllably releasing the top cementing plug and the bottom cementing plug into the wellbore casing. The bottom cementing plug includes a plug body defining a plug passage, a frangible membrane for sealing the plug passage, and a one-way valve for controlling the flow of fluidic materials through the plug passage. The invention also includes the bottom cementing plug and methods for operation.

21 Claims, 35 Drawing Sheets

U.S. PATENT DOCUMENTS

| | | | | | |
|---|---|---|---|---|---|
| RE29,830 | E | | 11/1978 | Scott | |
| 4,164,980 | A | | 8/1979 | Duke | 166/291 |
| 4,286,664 | A | | 9/1981 | Bolding | |
| 4,580,632 | A | | 4/1986 | Reardon | |
| 4,589,495 | A | * | 5/1986 | Langer et al. | 166/383 |
| 4,664,192 | A | * | 5/1987 | Hogarth | 166/291 |
| 4,862,958 | A | | 9/1989 | Pringle | |
| 4,880,058 | A | * | 11/1989 | Lindsey et al. | 166/289 |
| 4,934,452 | A | | 6/1990 | Bradley | |
| 5,018,579 | A | | 5/1991 | Braddick et al. | |
| 5,181,571 | A | | 1/1993 | Mueller et al. | |
| 5,323,858 | A | | 6/1994 | Jones et al. | |
| 5,413,172 | A | | 5/1995 | Laurel | |
| 5,435,386 | A | | 7/1995 | LaFleur | |
| 5,472,053 | A | | 12/1995 | Sullaway et al. | |
| 5,722,491 | A | | 3/1998 | Sullaway et al. | |
| 5,829,523 | A | * | 11/1998 | North | 166/250.14 |
| 5,960,881 | A | | 10/1999 | Allamon et al. | |
| 6,082,451 | A | | 7/2000 | Giroux et al. | |
| 6,311,775 | B1 | | 11/2001 | Allamon et al. | |
| 6,484,804 | B1 | | 11/2002 | Allamon et al. | |

* cited by examiner

CEMENTING SYSTEM AND METHOD FOR WELLBORES

CROSS REFERENCE TO RELATED APPLICATIONS

This application is a divisional application of application Ser. No. 09/968,659, filed Oct. 1, 2001, now issued as U.S. Pat. No. 6,752,209.

BACKGROUND

This invention relates generally to wellbores, and in particular to cementing systems for wellbores.

Referring to FIG. 1*a*, a conventional system 10 for cementing a wellbore 12 includes a shoe 14 defining a passage 14*a* that is coupled to an end of a tubular member 16 defining a passage 16*a*. The tubular member 16 typically includes one or more tubular members threadably coupled end to end. The other end of the tubular member 16 is coupled to an end of a float collar 18 including a float 18*a*. The other end of the float collar 18 is coupled to an end of a tubular member 20 defining a passage 20*a*. Centralizers 22*a*, 22*b*, and 22*c* are coupled to the exteriors of the tubular members, 16 and 18. More generally, the system 10 may include any number of centralizers. The other end of the tubular member 20 is coupled to a fluid injection assembly 24 defining a passage 24*a* and radial passages 24*b*, 24*c*, and 24*d*, and including retaining pins 24*e* and 24*f*. The fluid injection head 24 is commonly referred to as a cementing head. A bottom cementing plug 26 and a top cementing plug 28 are retained within the passage 24*a* of the fluid injection assembly 24 by the retaining pins 24*e* and 24*f*. The bottom cementing plug 26 typically includes a longitudinal passage that is sealed off by a frangible diaphragm.

During operation, as illustrated in FIG. 1*a*, drilling mud 30 is circulated through the wellbore 12 by injecting the drilling mud into the fluid injection assembly 24 through the radial passage 24*b*. The drilling mud 30 then passes through the passages 24*a*, 20*a*, 18*a*, and 14*a* into the annulus between the tubular member 20, the float collar 18, the tubular member 16, and the shoe 14. As illustrated in FIG. 1*b*, the bottom cementing plug 26 is then released and a spacer fluid 32 followed by a cement slurry 34 are injected into the injection assembly 24 through the radial passage 24*c* behind and above the bottom cementing plug. As illustrated in FIG. 1*c*, the top cementing plug 28 is then released and a displacing fluid 36 is injected into the injection assembly 24 through the radial passage 24*d* behind and above the top cementing plug. As illustrated in FIG. 1*d*, the continued injection of the displacing fluid 36 displaces the bottom cementing plug 26 into contact with the float collar 18 and breaks the frangible membrane of the bottom cementing plug thereby causing the cement slurry 34 to flow into the annulus between the wellbore 12 and the shoe 14, the tubular member 16, the float collar 18, and the tubular member 20. As illustrated in FIG. 1*e*, the continued injection of the displacing fluid 36 then displaces the top cementing plug 28 downwardly until the top cementing plug impacts the bottom cementing plug 26. The float element 18*a* of the float collar 18 prevents back flow of the cement slurry 34 into the tubular member 20. The cement slurry 34 may then be allowed to cure.

Referring to FIG. 2*a*, another conventional system 100 for cementing a wellbore 102 having a preexisting wellbore casing 104 includes a float shoe 106 including a float element 106*a* that is coupled to an end of a tubular member 108 defining a passage 108*a*. The other end of the tubular member 108 is coupled to an end of a landing collar 110 defining a passage 110*a*. The other end of the landing collar 110 is coupled to an end of a tubular member 112 defining a passage 112*a*. A liner hanger 114 is coupled to the tubular member 112 for permitting the tubular member to be coupled to and supported by the preexisting wellbore casing 104. A centralizer 116 is also coupled to the exterior of the tubular member 112 for centrally positioning the tubular member inside the preexisting wellbore casing 104. An end of a tubular support member 118 defining a passage 118*a* extends into the other end of the tubular member 112. A releasable coupling 120 is coupled to the tubular support member 118 for releasably coupling the tubular support member to the tubular member 112. A wiper plug 122 defining a restricted passage 122*a* is coupled to an end of the tubular support member 118 within the other end of the tubular member 112. A bumper 124 and a cup seal 126 are coupled to the exterior of the end of the tubular support member 118 within the tubular member 112.

During operation, as illustrated in FIG. 2*a*, drilling mud 128 is circulated through the wellbore 102 by injecting the drilling mud through the passages 118*a*, 122*a*, 112*a*, 110*a*, 108*a*, and 106*a* into the annulus between the float shoe 106, the tubular member 108, the landing collar 110, and the tubular member 112. As illustrated in FIG. 2*b*, a spacer fluid 130 followed by a cement slurry 132 are then injected into the passages 118*a*, 122*a*, and 112*a* behind and above the drilling mud 128. As illustrated in FIG. 2*c*, a pump down plug 134 is then injected into the passage 118*a* followed by a displacing fluid 136. As illustrated in FIG. 2*d*, the continued injection of the displacing fluid 136, causes the pump down plug 134 to engage the restricted passage 122*a* of the wiper plug 122 thereby disengaging the wiper plug from the end of the tubular support member 118. As a result, the wiper plug 122 and the pump down plug 134 are driven downwardly within the tubular member 112 by the continued injection of the displacing fluid 136 which in turn displaces the spacer fluid 130 and the cement slurry 132 into the annulus between the wellbore 102 and the float shoe 106, the tubular member 108, the landing collar 110 and the tubular member. As illustrated in FIG. 2*e*, the continued injection of the displacing fluid 136 causes the wiper plug 122 and the pump down plug 134 to impact the landing collar 110 and engage the passage 110*a*. Furthermore, as illustrated in FIG. 2*e*, the continued injection of the displacing fluid 136 fills the annulus between the wellbore 102 and the tubular member 112 with the cement slurry 132. The float element 106*a* of the float shoe 106 prevents back flow of the cement slurry into the tubular member 108. As illustrated in FIG. 2*f*, the tubular support member 118 is then decoupled from the tubular member 112 and raised away from the end of the tubular member 112. The spacer liquid 130 and any excess cement slurry 132 may then be removed by circulating drilling mud 138 through the annulus between the tubular support member 118 and the preexisting wellbore casing 104. The cement slurry 132 may then be allowed to cure.

Referring to FIG. 3*a*, yet another conventional system 200 for cementing a wellbore 202 having a preexisting wellbore casing 204 includes a float shoe 206 including a float element 206*a* that is coupled to an end of a tubular member 208 defining a passage 208*a*. The other end of the tubular member 208 is coupled to an end of a landing collar 210 defining a passage 210*a*. The other end of the landing collar 210 is coupled to an end of a tubular member 212 defining a passage 212*a*. A centralizer 214 is coupled to the exterior of the tubular member 212 for centrally positioning the tubular member inside the preexisting wellbore casing 204. An end of a tubular support member 216 defining a passage 216*a* extends into the other end of the tubular member 212 and the other end of the tubular support member 216 is coupled to a conventional subsea cementing head. A releasable coupling 218 is coupled to the tubular support member 216 for releasably coupling the tubular support member to the tubular member 212. A wiper plug 220 defining a restricted passage 220*a* is coupled to an end of the tubular support member 216 within the other end of the tubular member 212. A bumper 222 and a cup seal 224 are coupled to the exterior of the end of the tubular support member 216 within the tubular member 212.

During operation, as illustrated in FIG. 3*a*, drilling mud 226 is circulated through the wellbore 202 by injecting the drilling mud through the passages 216*a*, 220*a*, 212*a*, 210*a*, 208*a*, and 206*a* into the annulus between the float shoe 206, the tubular member 208, the landing collar 210, and the tubular member 212. As illustrated in FIG. 3*b*, a spacer fluid 228 followed by a cement slurry 230 are then injected into the passages 216*a*, 220*a*, and 212*a* behind and above the drilling mud 226. As illustrated in FIG. 3*c*, a pump down plug 232 is then injected into the passage 216*a* followed by a displacing fluid 234. As illustrated in FIG. 3*d*, the continued injection of the displacing fluid 234, causes the pump down plug 232 to engage the restricted passage 220*a* of the wiper plug 220 thereby disengaging the wiper plug from the end of the tubular support member 216. As a result, the wiper plug 220 and the pump down plug 232 are driven downwardly within the tubular member 212 by the continued injection of the displacing fluid 234 which in turn displaces the spacer fluid 228 and the cement slurry 230 into the annulus between the wellbore 202 and the float shoe 206, the tubular member 208, the landing collar 210 and the tubular member. As illustrated in FIG. 3*e*, the continued injection of the displacing fluid 234 causes the wiper plug 220 and the pump down plug 232 to impact the landing collar 210 and engage the passage 210*a*. Furthermore, as illustrated in FIG. 3*e*, the continued injection of the displacing fluid 234 fills the annulus between the wellbore 202 and the tubular member 212 with the cement slurry 230. The float element 206*a* of the float shoe prevents back flow of the cement slurry 230 into the tubular member 208. The tubular support member 216 is then decoupled from the tubular member 212 and raised out of the wellbore 202. The cement slurry 230 may then be allowed to cure.

Thus, conventional systems for cementing a wellbore require the use of a float collar and/or a float shoe in order to prevent the back flow of the cement slurry. As a result, conventional systems for cementing a wellbore typically restrict circulation, and generate surge pressures that can damage the subterranean formations and induce the loss of valuable drilling fluids. Furthermore, conventional systems also increase casing and liner running times and open hole exposure times, and expose floating valves to drilling fluid circulation thereby eroding the floating valves and compromising their proper operation. Furthermore, the conventional equipment used for cementing wellbores is also complex, and is expensive to operate. In addition, because conventional float collars and/or float shoes, and the required related operating equipment, are large, heavy, and fragile, the cost of transporting such equipment is often expensive.

The present invention is directed to overcoming one or more of the limitations of existing cementing systems for wellbores.

SUMMARY

According to one embodiment of the invention, an apparatus for cementing an annulus between a wellbore casing and a wellbore is provided that includes a landing collar defining a restricted passage, a wellbore casing defining a passage coupled to the landing collar, a top cementing plug for sealingly engaging the wellbore casing, a bottom cementing plug for sealingly engaging the wellbore casing, and a fluid injection assembly coupled to the wellbore casing for injecting fluidic materials into the wellbore casing and controllably releasing the top cementing plug and the bottom cementing plug into the wellbore casing. The bottom cementing plug includes a plug body defining a plug passage, a frangible membrane for sealing the plug passage, and a one-way valve for controlling the flow of fluidic materials through the plug passage.

According to another embodiment of the invention, a method of cementing an annulus between a wellbore casing and a wellbore is provided that includes positioning a wellbore casing defining a passage and including a landing collar at one end defining a restricted passage into the wellbore, injecting a non-hardenable fluidic material into the other end of the wellbore casing, injecting a bottom cementing plug into the other end of the wellbore casing, the bottom cementing plug including a plug body defining a plug passage, a frangible membrane for sealing the plug passage, and a one-way valve for controlling the flow of fluidic materials through the plug passage, injecting a hardenable fluidic sealing material into the other end of the wellbore casing, injecting a top cementing plug into the other end of the wellbore casing, injecting a non-hardenable fluidic material into the other end of the wellbore casing, breaking the frangible membrane of the bottom cementing plug to permit the hardenable fluidic sealing material to pass through the plug passage, the one-way valve, and the restricted passage into the annulus between the tubular member and the wellbore, and the one-way valve preventing the hardenable fluidic sealing material from passing from annulus back into the wellbore casing.

According to another embodiment of the invention, a system for cementing an annulus between a wellbore casing and a wellbore is provided that includes means for positioning the wellbore casing into the wellbore, means for injecting a non-hardenable fluidic material into the wellbore casing, means for injecting a hardenable fluidic sealing material into the wellbore casing, means for separating the non-hardenable fluidic material and the hardenable fluidic sealing material within the wellbore casing, means for pressurizing the hardenable fluidic sealing material within the wellbore casing, means for controllably releasing the hardenable fluidic sealing material into the annulus between the wellbore casing and the wellbore, and means for preventing the hardenable fluidic sealing material from flowing from the annulus into the wellbore casing.

According to another embodiment of the invention, a bottom cementing plug for use in a system for cementing an annulus between a wellbore casing and a wellbore is provided that includes a plug body defining a plug passage, a sealing element coupled to the plug body for sealingly engaging the wellbore casing, a frangible membrane for sealing the plug passage, and a one-way valve for controlling the flow of fluidic materials through the plug passage.

According to another embodiment of the invention, an apparatus for cementing an annulus between a tubular liner and a wellbore including a preexisting wellbore casing is provided that includes a tubular support member, a wiper plug releasably coupled to an end of the tubular support member, a tubular liner releasably coupled to tubular support member, a landing collar defining a restricted passage coupled to an end of the tubular liner, a cementing plug for sealingly engaging the tubular liner and releasably coupled to the wiper plug, including a plug body defining a plug passage and a valve for controlling the flow of fluidic materials through the plug passage, and a fluid injection assembly coupled to the tubular support member for injecting fluidic materials into the tubular support member and controllably releasing a ball and a pump down plug into the tubular support member for engaging the cementing plug and the wiper plug.

According to another embodiment of the invention, a method of cementing an annulus between a tubular liner and a wellbore including a preexisting wellbore casing is provided that includes releasably supporting a tubular liner defining a passage and including a landing collar at one end defining a restricted passage within the wellbore using a tubular support member defining a passage fluidicly coupled to the passage of the tubular liner and including a wiper plug releasably coupled to an end of the tubular support member, releasably coupling a cementing plug to the wiper plug within the tubular member, the cementing plug including a plug body defining a plug passage and a valve for controlling the flow of fluidic materials through the plug passage, injecting a non-hardenable fluidic material into the passage of the tubular support member, injecting a ball into the passage of the tubular support member, injecting a hardenable fluidic sealing material into the passage of the tubular support member, the ball decoupling the cementing plug from the wiper plug, the cementing plug engaging the landing collar, injecting a pump down plug into the passage of the tubular support member, injecting a non-hardenable fluidic material into the passage of the tubular support member, decoupling the wiper plug from the end of the tubular support member, and the wiper plug and the pump down plug engaging the cementing plug.

According to another embodiment of the invention, a system for cementing an annulus between a tubular liner and a wellbore is provided that includes means for injecting a non-hardenable fluidic material into the tubular liner, means for injecting a hardenable fluidic sealing material into the tubular liner, means for separating the non-hardenable fluidic material and the hardenable fluidic sealing material within the tubular liner, means for pressurizing the hardenable fluidic sealing material within the tubular liner, means for controllably releasing the hardenable fluidic sealing material into the annulus between the tubular liner and the wellbore, and means for preventing the hardenable fluidic sealing material from flowing from the annulus into the tubular liner.

According to another embodiment of the invention, a bottom cementing plug for use in a system for cementing an annulus between a wellbore casing and a wellbore is provided that includes a plug body defining a passage, a frangible ball seat positioned within one end of the passage, a one way valve positioned within another end of the passage for controlling the flow of fluidic materials through the passage, and a frangible retaining member positioned within the other end of the passage for retaining the one way valve in a stationary position.

The present embodiments of the invention provide a number of advantages over conventional systems for cementing wellbores. For example, the present embodiments of the invention eliminate the float collar that is required in conventional systems. As a result, during the operation of the present embodiments of the invention, drilling mud does not have to be circulated through the floating equipment in order to stabilize the wellbore prior to cementing. Furthermore, the present embodiments of the invention also permit a larger internal diameter system to be used throughout thereby increasing the operational efficiency. Furthermore, the operational and logistical costs associated with shipping and assembling the float collar, and related equipment, are eliminated by the present embodiments of the invention. In addition, the present embodiments of the invention reduces restrictions to circulation, reduces surge and swab pressures, reduces fluid losses to the subterranean formation, reduces casing and liner running times, reduces the open hole exposure time, and reduces the loss of valuable drilling fluids to the formation.

DESCRIPTION OF THE PREFERRED EMBODIMENTS

Figure 1A:
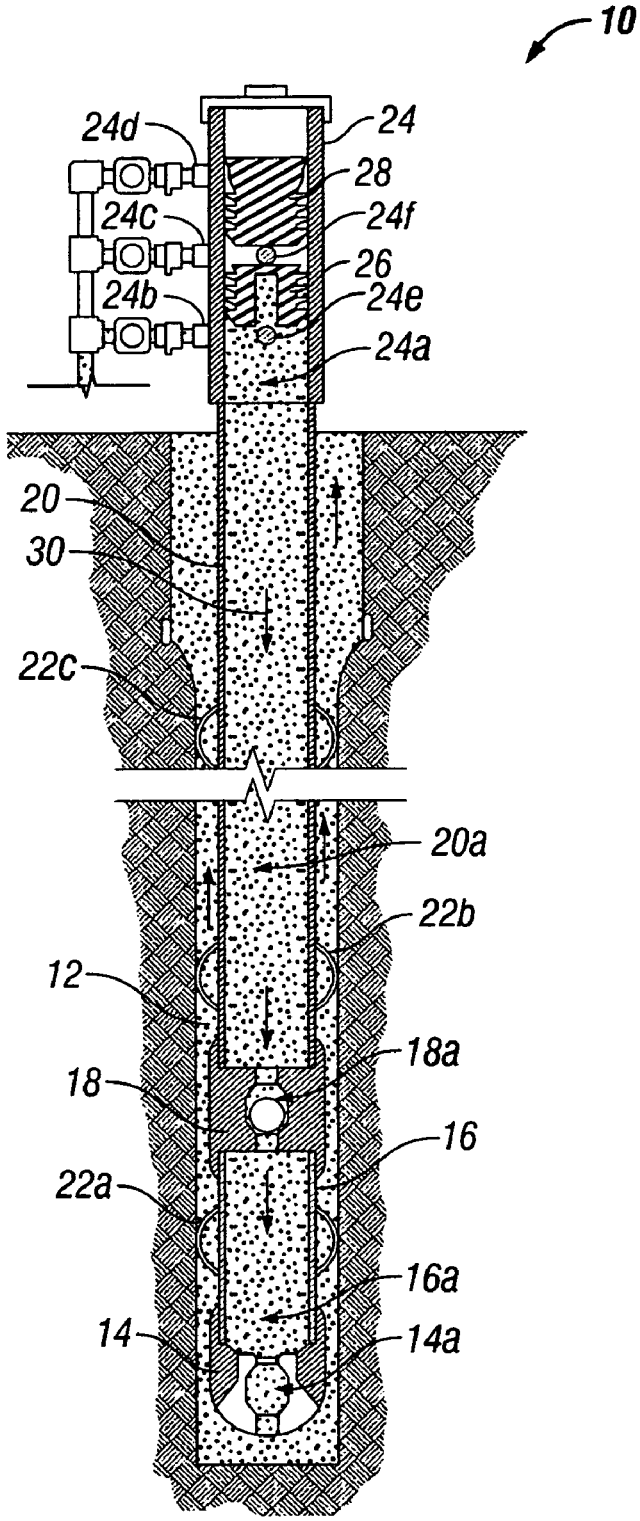
FIG. 1A Prior Art
FIGS. 1*a*–1*e* are fragmentary cross-sectional illustrations of an embodiment of a conventional system for cementing a wellbore.
Figure 1B:
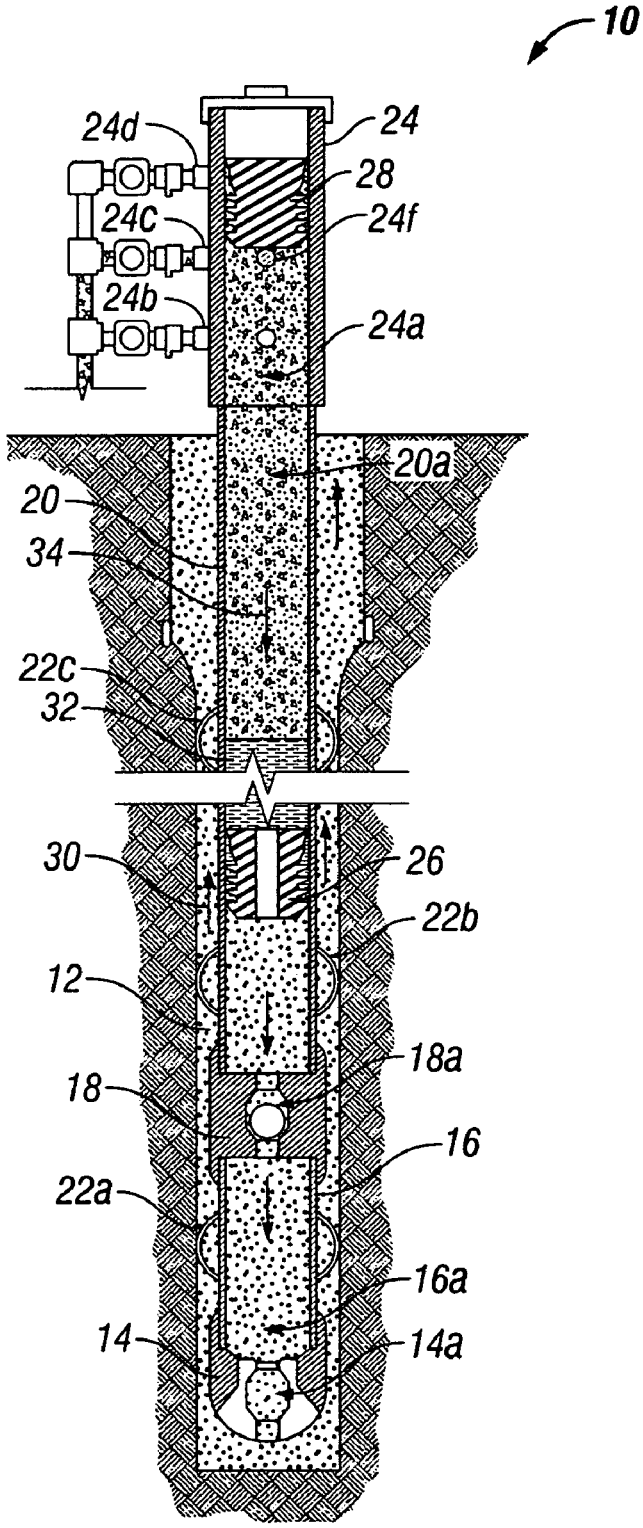
FIG. 1B Prior Art
Figure 1C:
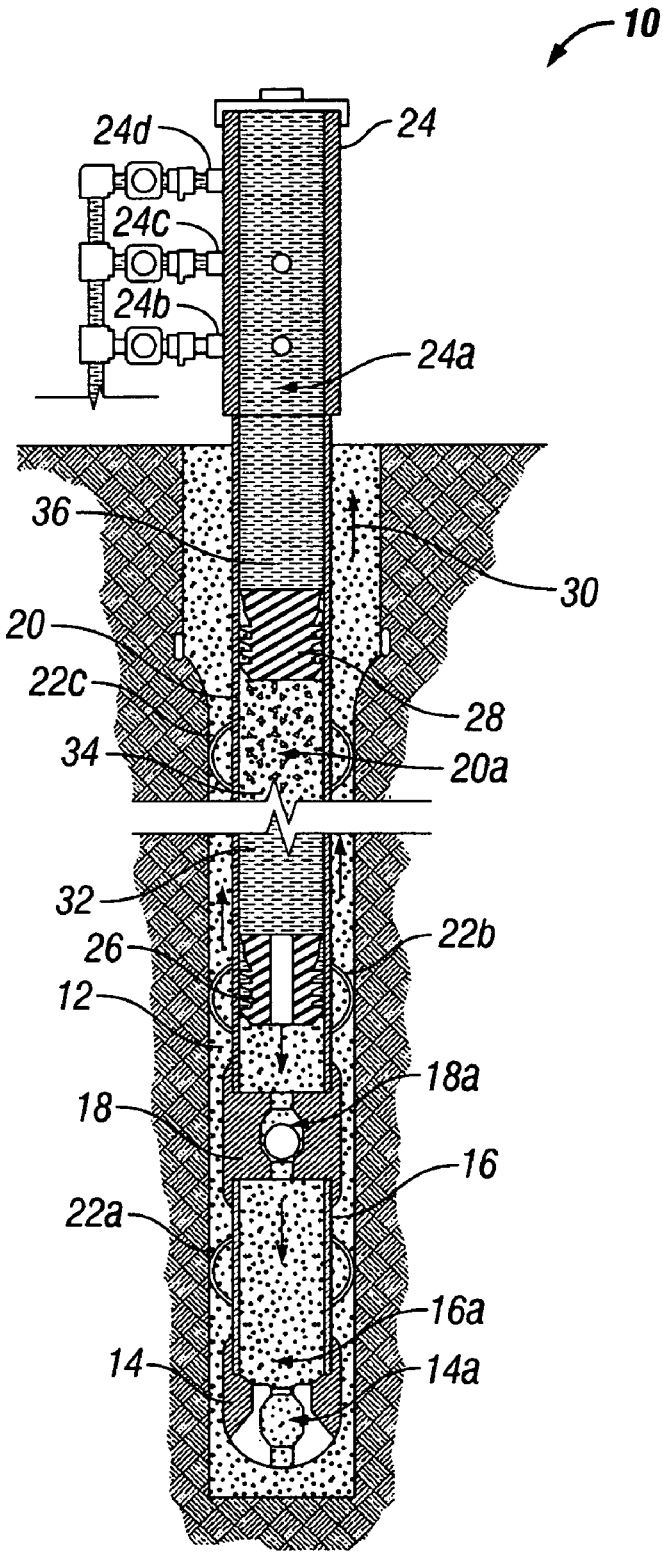
FIG. 1C Prior Art
Figure 1D:
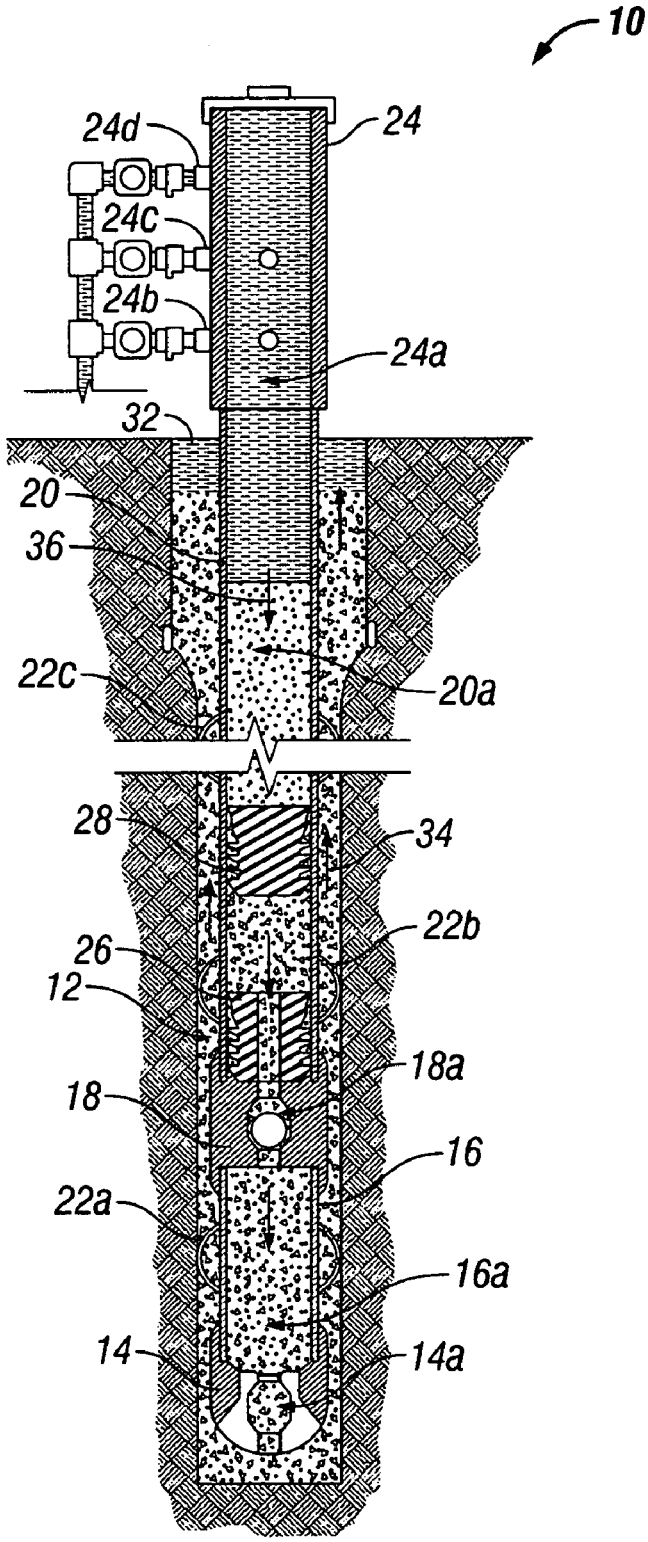
FIG. 1D Prior Art
Figure 1E:
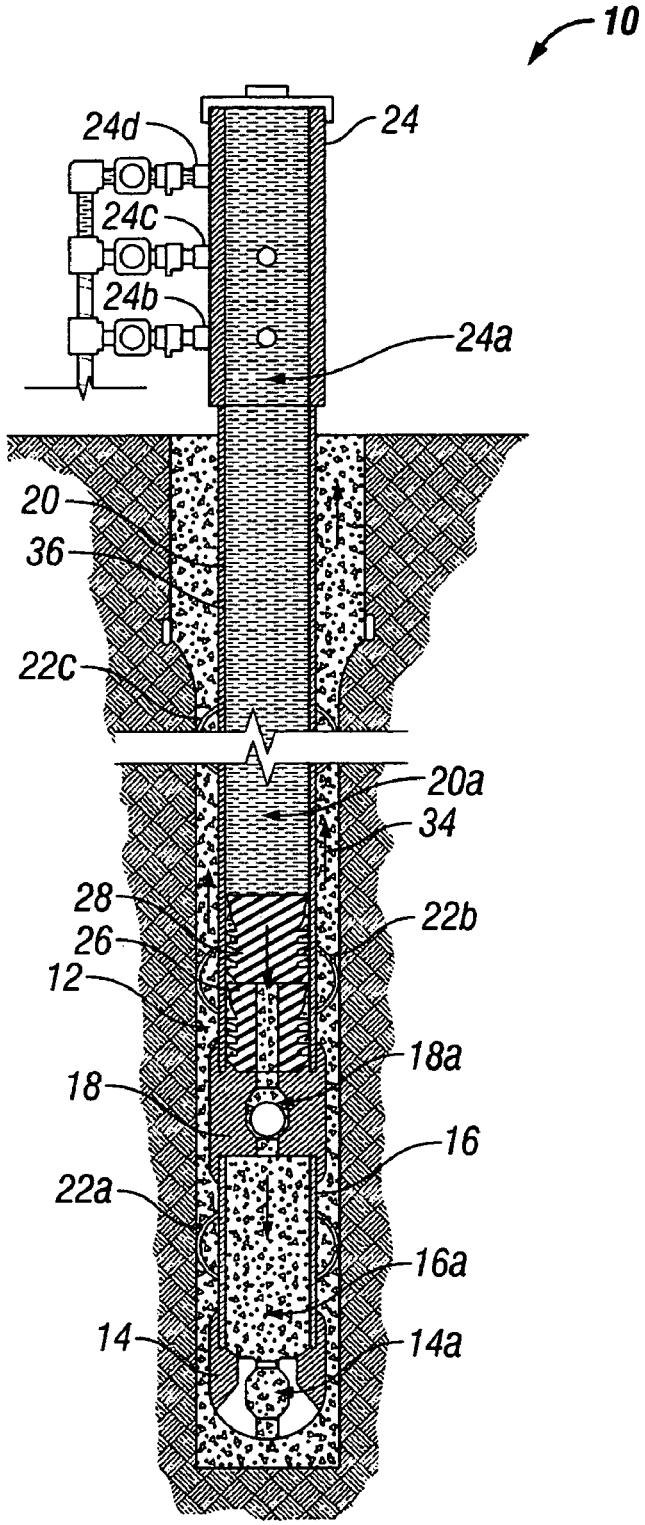
FIG. 1E Prior Art
Figure 2A:
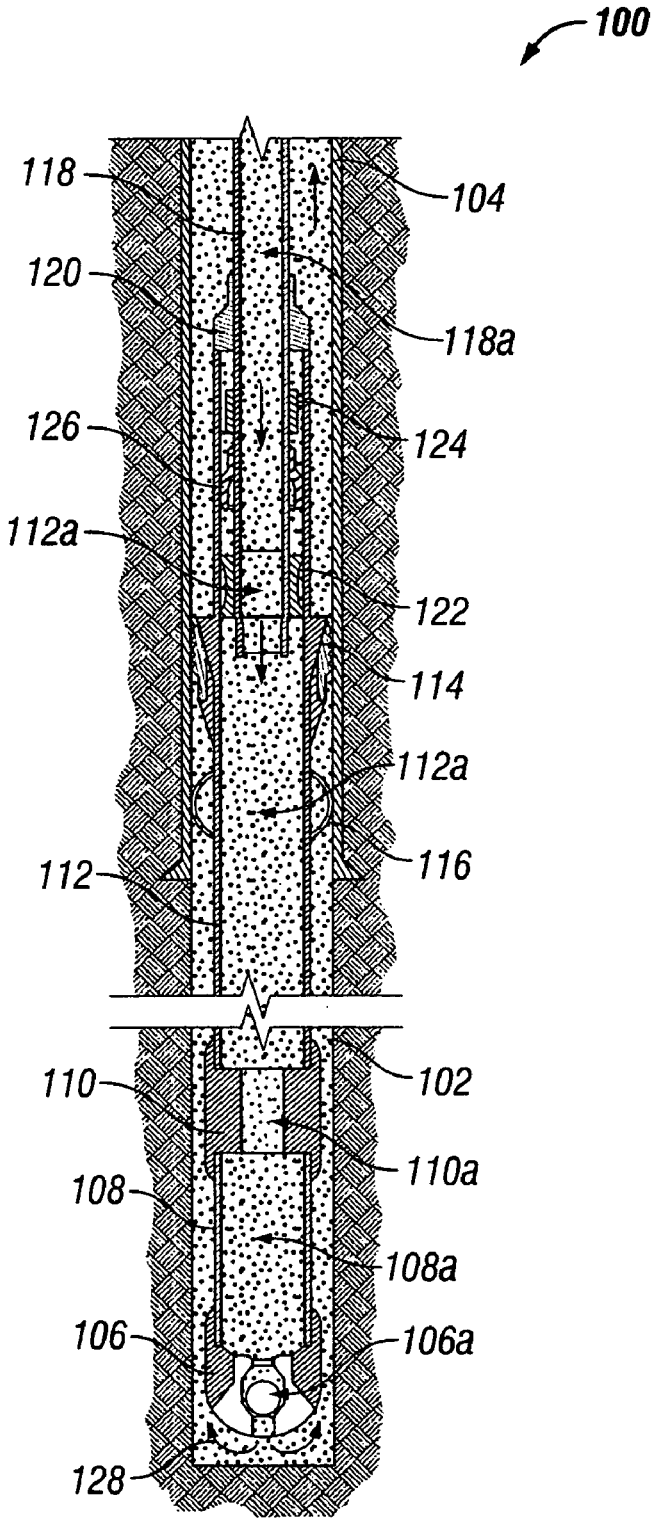
FIG. 2A Prior Art
FIGS. 2*a*–2*f* are fragmentary cross-sectional illustrations of another embodiment of a conventional system for cementing a wellbore.
Figure 2B:
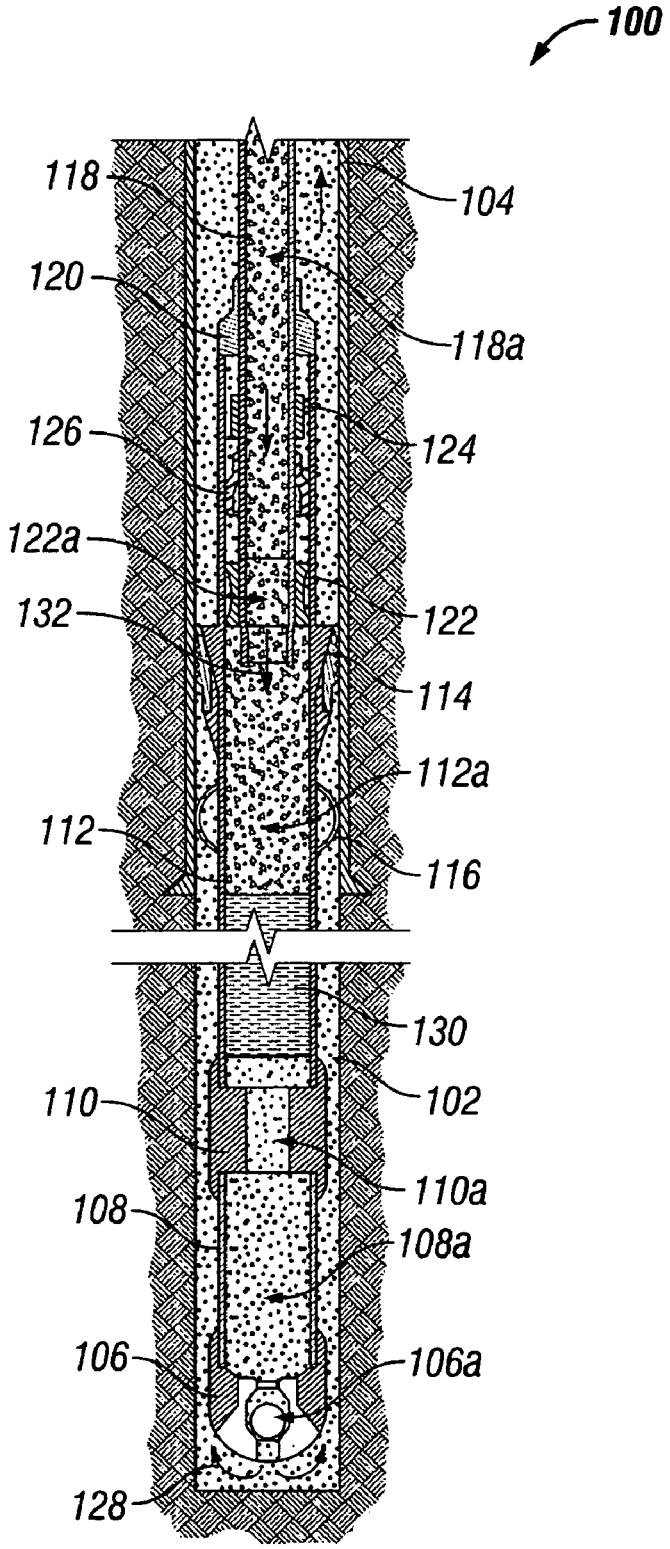
FIG. 2B Prior Art
Figure 2C:
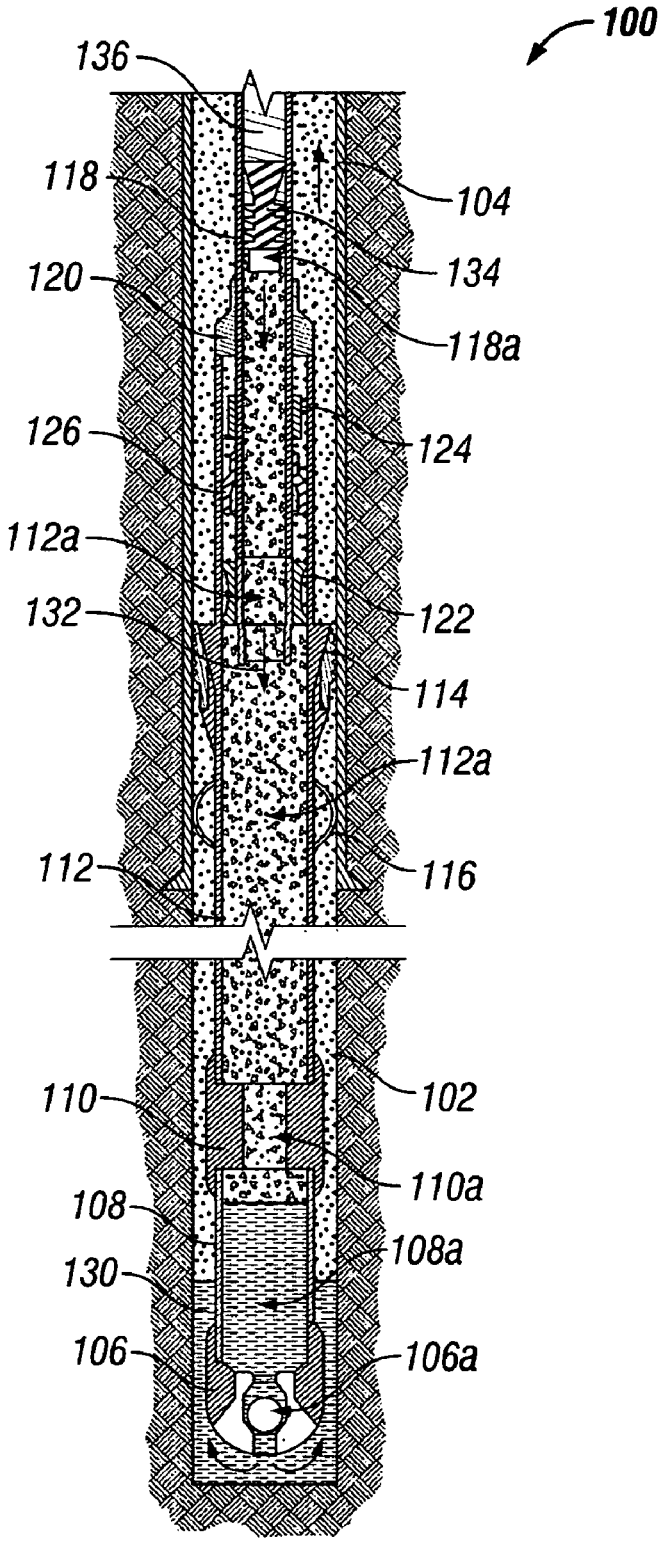
FIG. 2C Prior Art
Figure 2D:
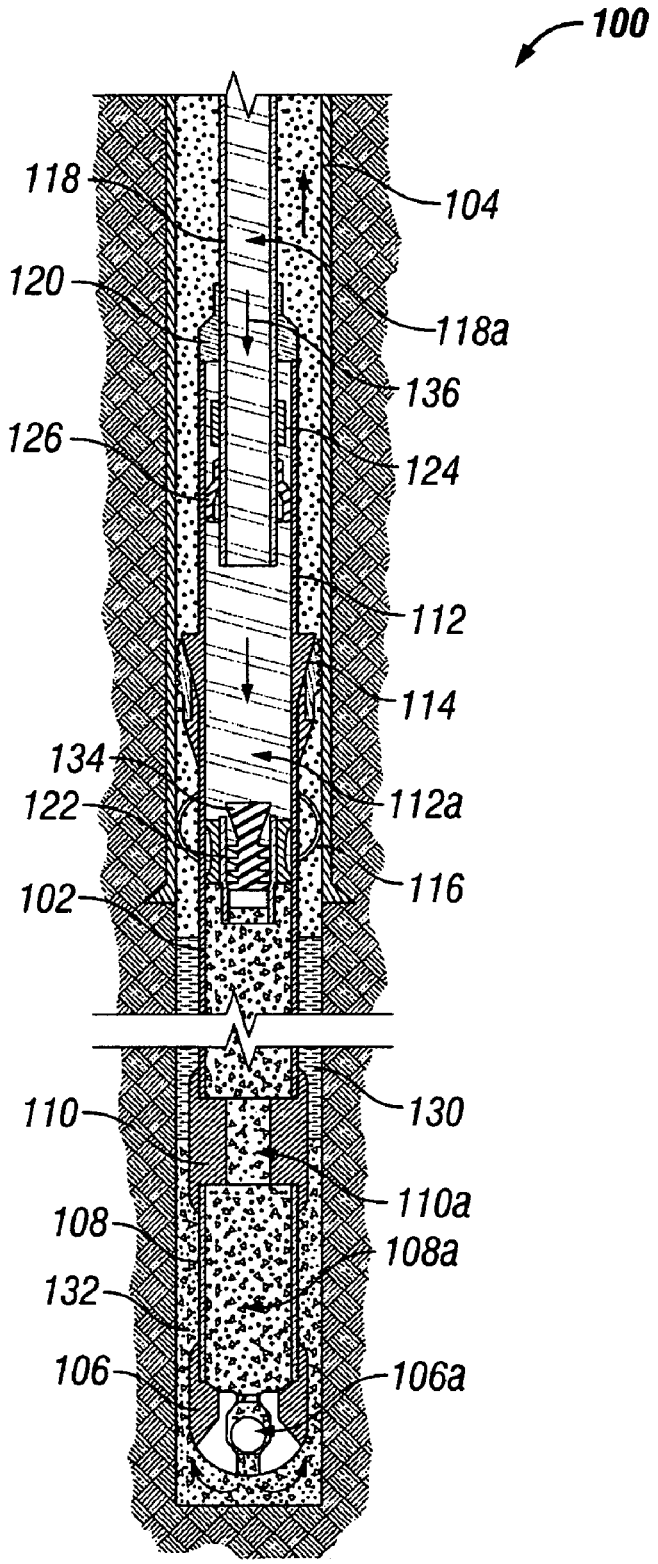
FIG. 2D Prior Art
Figure 2E:
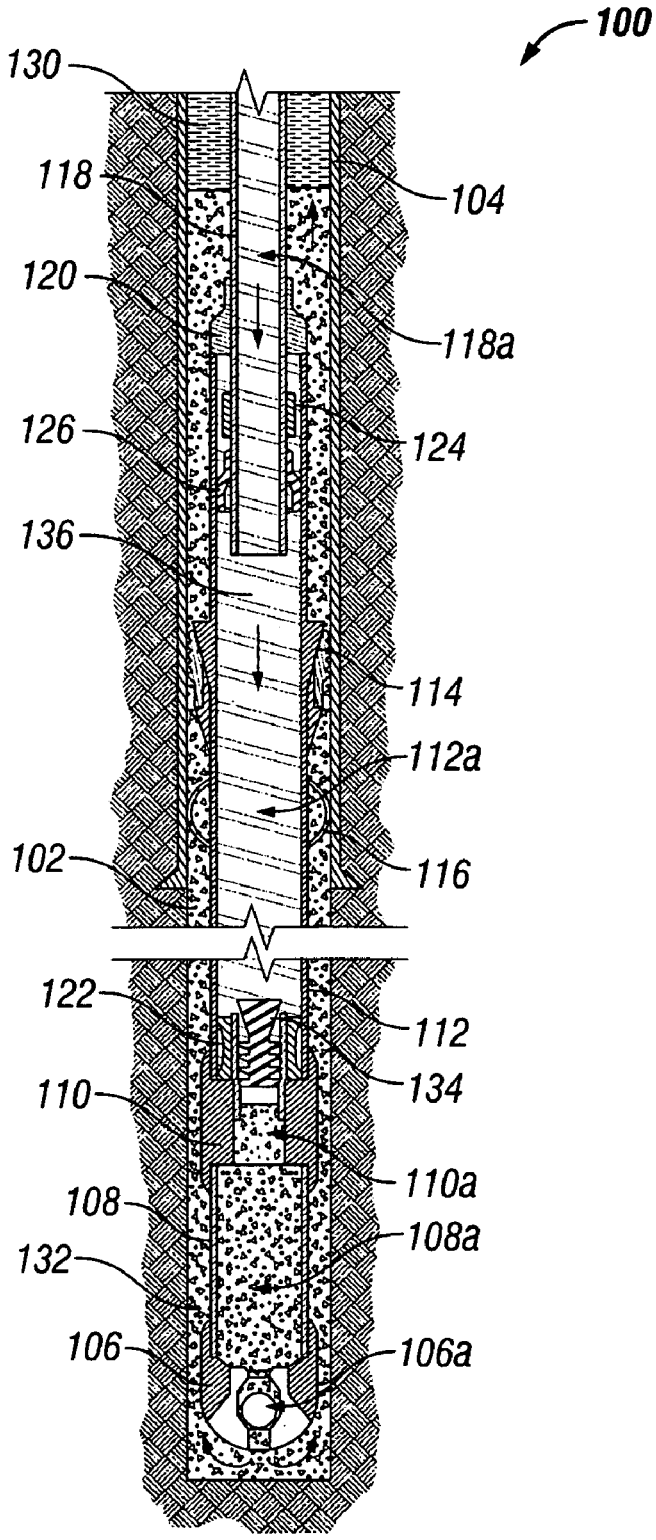
FIG. 2E Prior Art
Figure 2F:
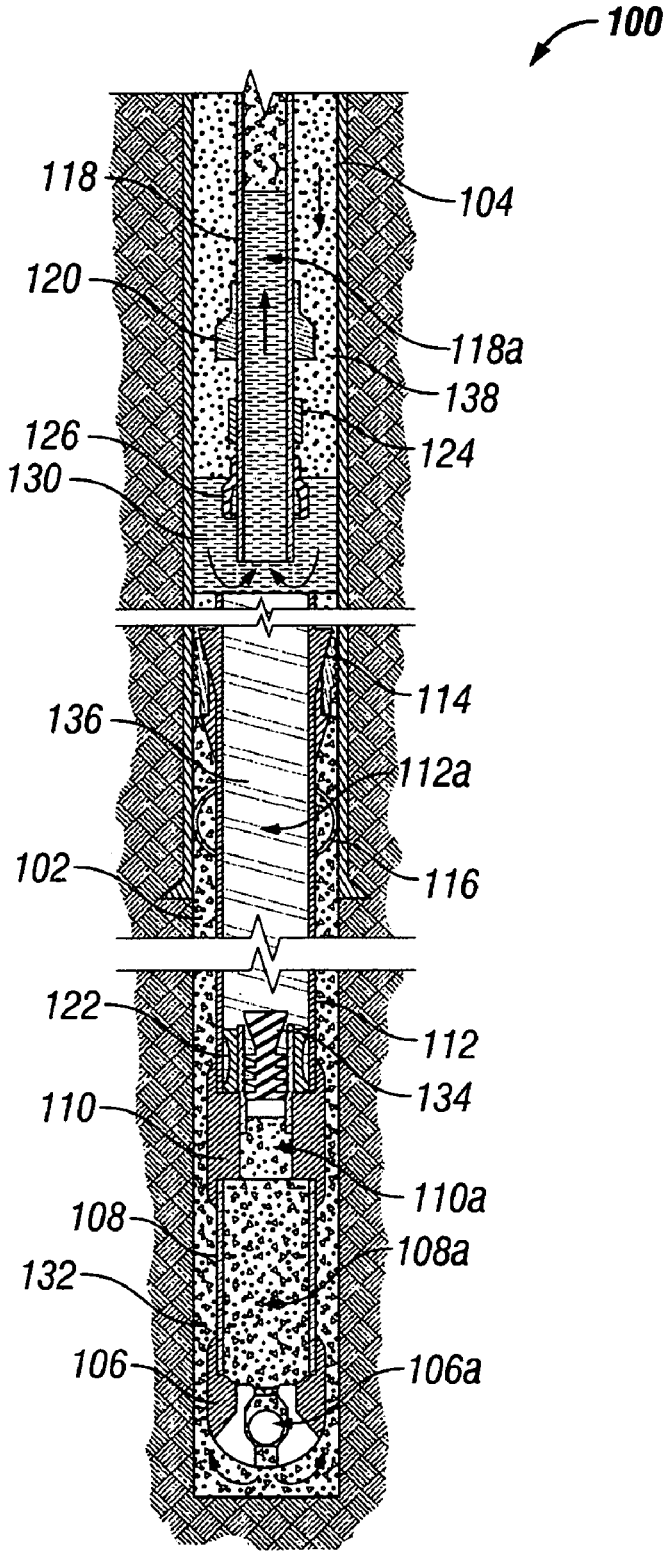
FIG. 2F Prior Art
Figure 3A:
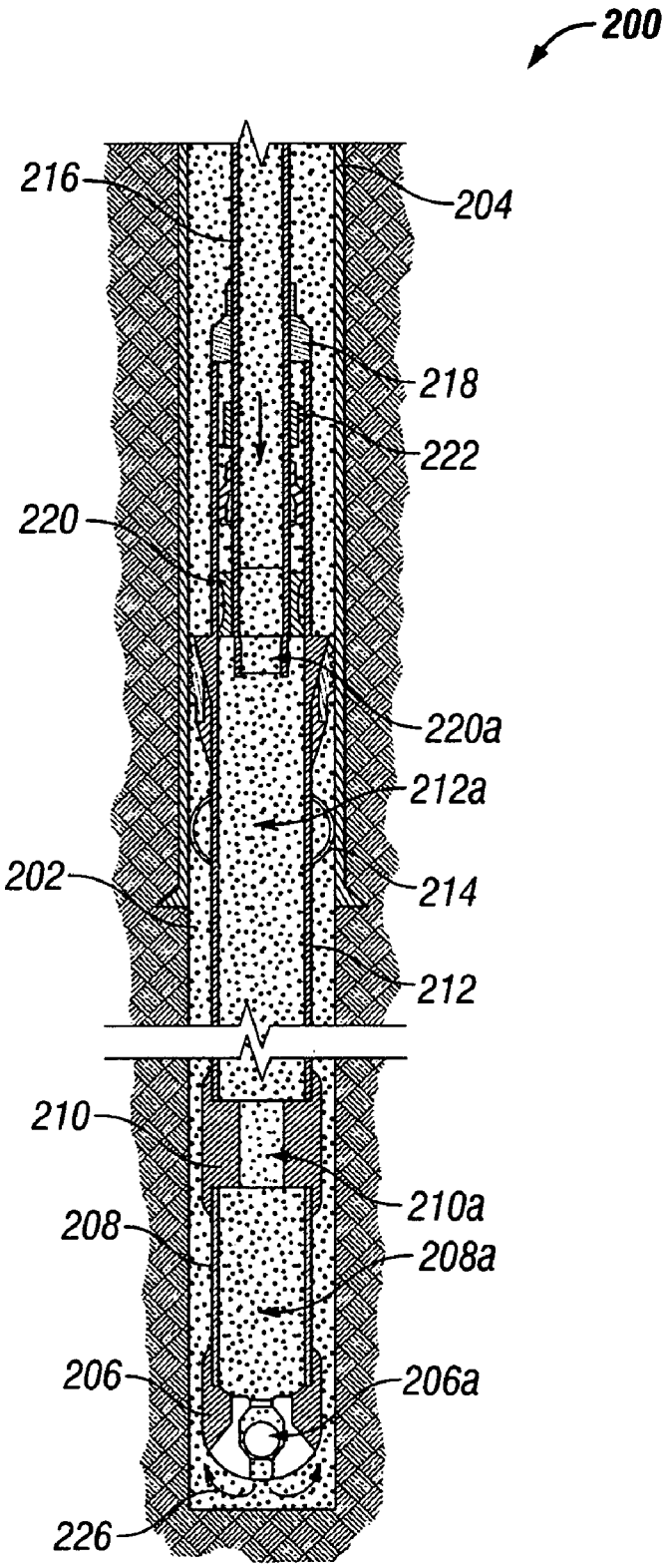
FIG. 3A Prior Art
FIGS. 3*a*–3*e* are fragmentary cross-sectional illustrations of another embodiment of a conventional system for cementing a wellbore.
Figure 3B:
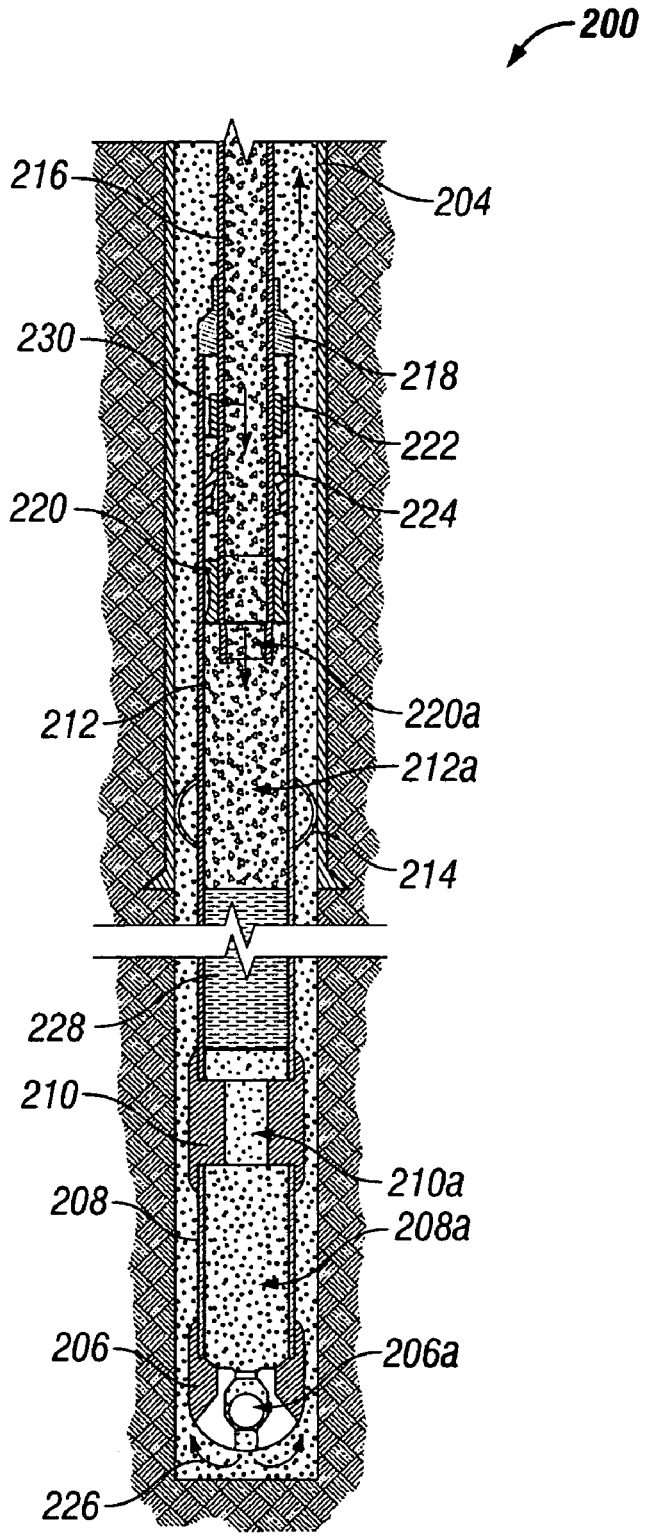
FIG. 3B Prior Art
Figure 3C:
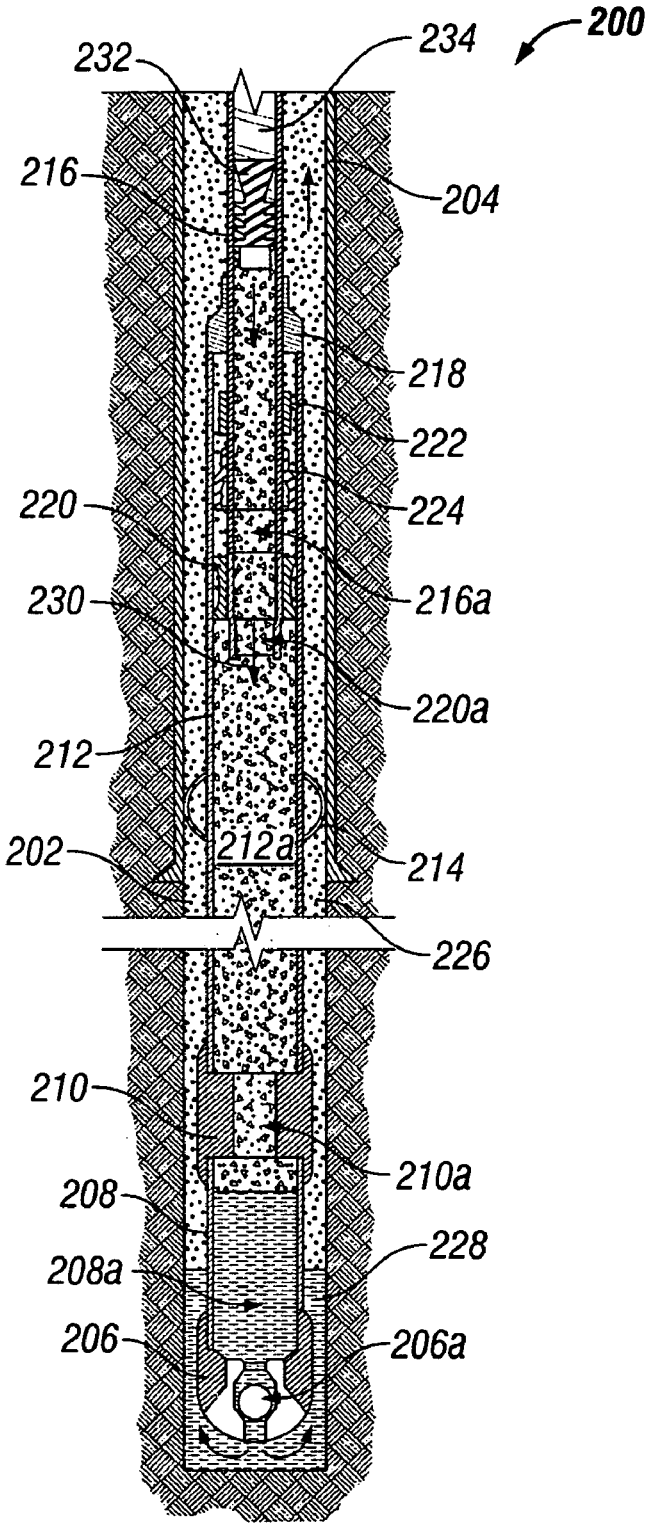
FIG. 3C Prior Art
Figure 3D:
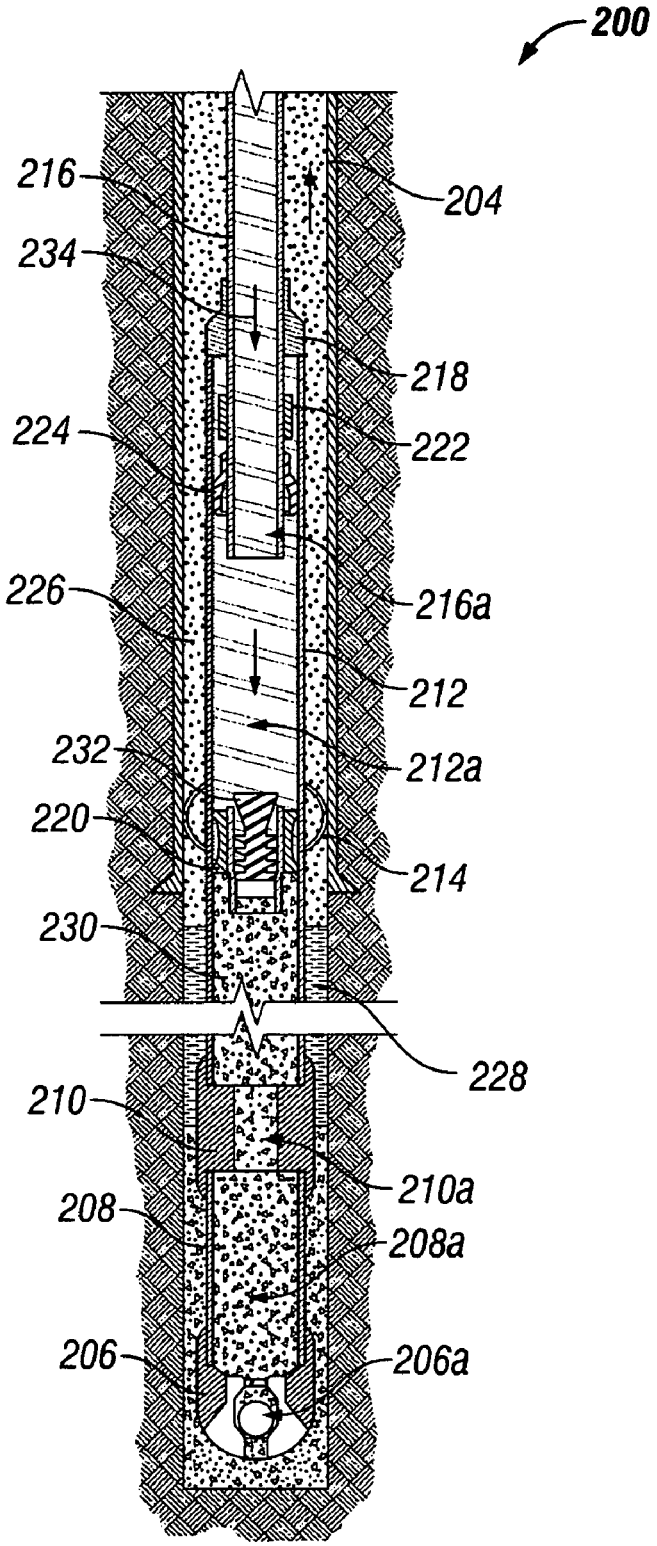
FIG. 3D Prior Art
Figure 3E:
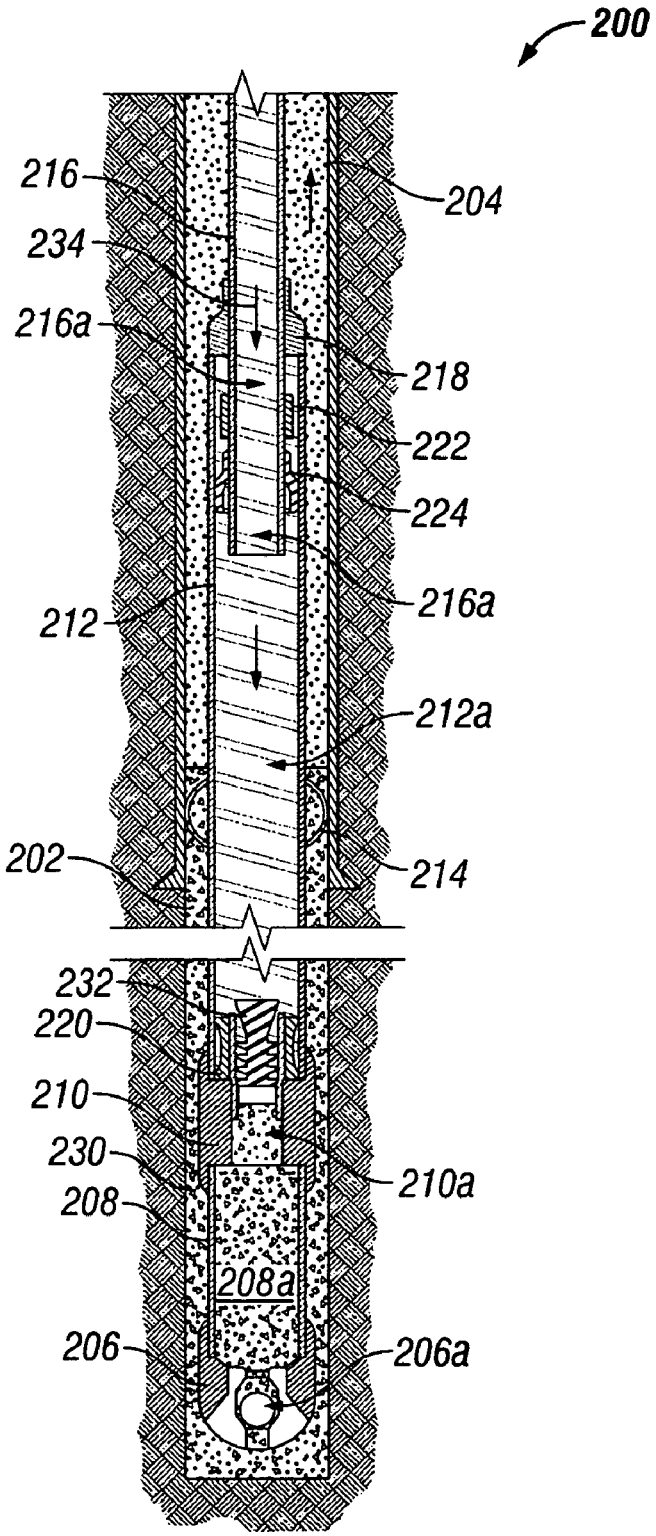
FIG. 3E Prior Art

Referring to FIGS. 4*a*–4*e*, the reference numeral 400 refers, in general, to a system for cementing a wellbore 402 according to an embodiment of the invention that includes a shoe 404 defining a passage 404*a* that is coupled to an end of a tubular member 406 defining a passage 406*a*. The other end of the tubular member 406 is coupled to an end of a landing collar 408 defining a passage 408*a*. The other end of the landing collar 408 is coupled to an end of a tubular member 410 defining a passage 410*a*. Centralizers 412*a*, 412*b*, and 412*c* may be coupled to the exteriors of the tubular members, 406 and 410. The other end of the tubular member 410 is coupled to a fluid injection assembly 414 defining a passage 414*a* and radial passages 414*b*, 414*c*, and 414*d*, and including retaining pins 414*e* and 414*f*. A bottom cementing plug 416 and a top cementing plug 418 are retained within the passage 414*a* of the fluid injection assembly 414 by the retaining pins 414*e* and 414*f*.

Figure 5:
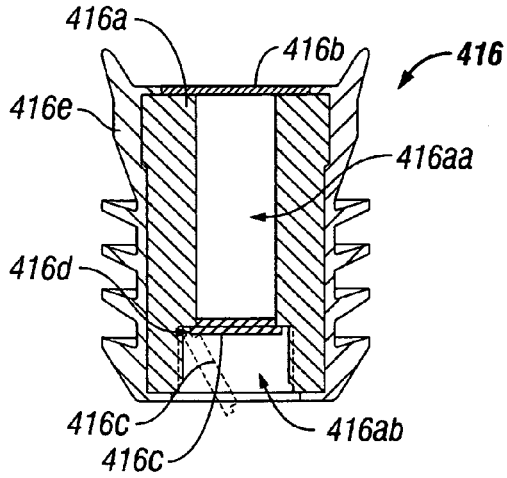
FIG. 5 is a cross-sectional illustration of an embodiment of a bottom cementing plug for use in the system of FIGS. 4*a*–4*e*.

Referring to FIG. 5, in an exemplary embodiment, the bottom cementing plug 416 includes a tubular body 416*a* defining a passage 416*aa* and a passage 416*ab*. A frangible disc 416*b* is coupled to an end of the tubular body 416*a* to seal off an end of the passage 416*aa*. A flapper check valve 416*c* is pivotally coupled to the other end of the tubular body 416*a* by a pivot support 416*d* and positioned within the intersection of the passages, 416*aa* and 416*ab*, for preventing the flow of fluidic materials from the passage 416*ab* into the passage 416*aa*. In an exemplary embodiment, the flapper check valve 416*c* is resiliently biased to pivot about the pivot support 416*d* and thereby close off the passage 416*aa*. A resilient tubular sealing member 416*e* is coupled to the exterior of the tubular body 416*a* for sealing the interface between the bottom cementing plug 416 and the tubular member 410. During operation, the flapper check valve 416*c* permits fluidic materials to flow from the passage 416*aa* into the passage 416*ab*, and prevents fluidic materials from flowing from the passage 416*ab* into the passage 416*aa*.

Figure 4A:
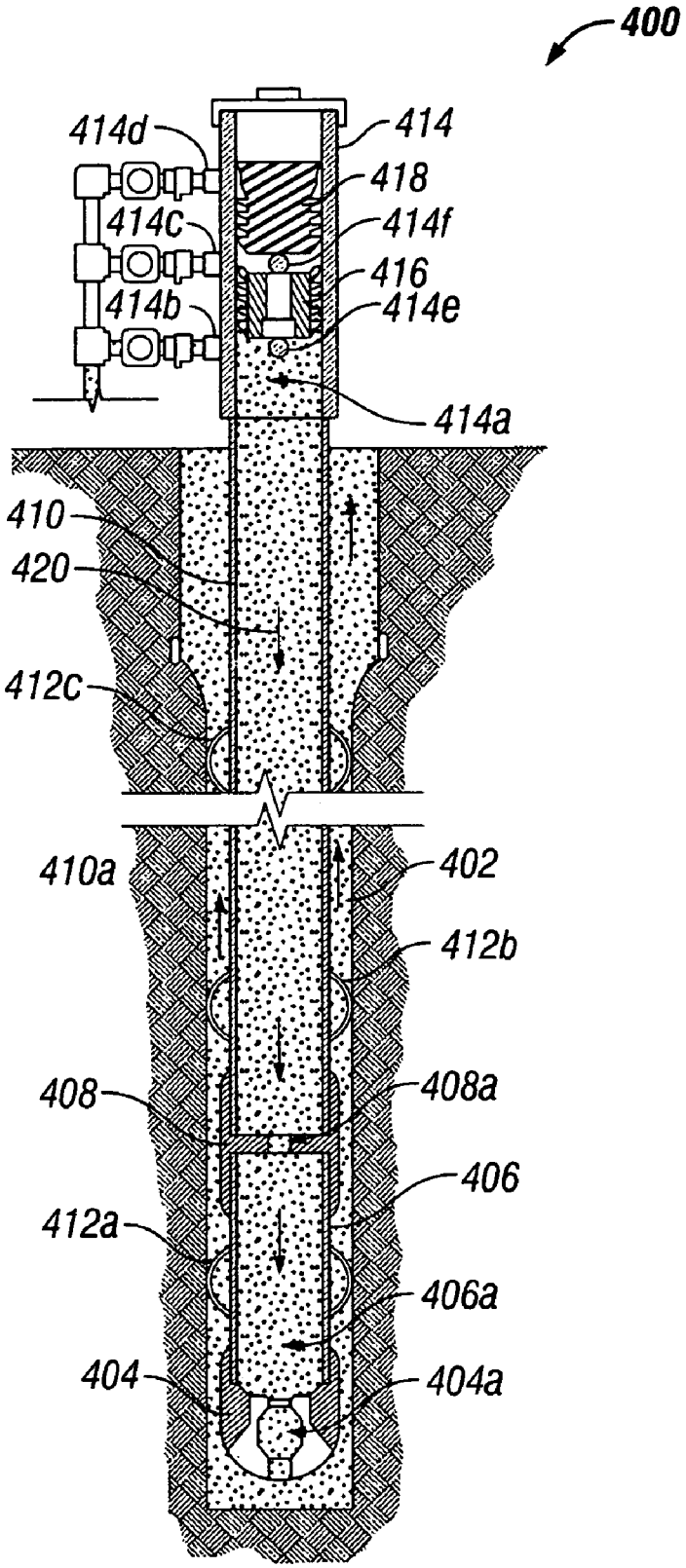
FIGS. 4*a*–4*e* are fragmentary cross-sectional illustrations of an embodiment of a system for cementing a wellbore.

During operation, as illustrated in FIG. 4*a*, drilling mud 420 is circulated through the wellbore 402 by injecting the drilling mud into the fluid injection assembly 414 through the radial passage 414*b*. The drilling mud 420 then passes through the passages 414*a*, 410*a*, 408*a*, 406*a*, and 404*a* into the annulus between the tubular member 410, the landing collar 408, the tubular member 406, and the shoe 404.

Figure 4B:
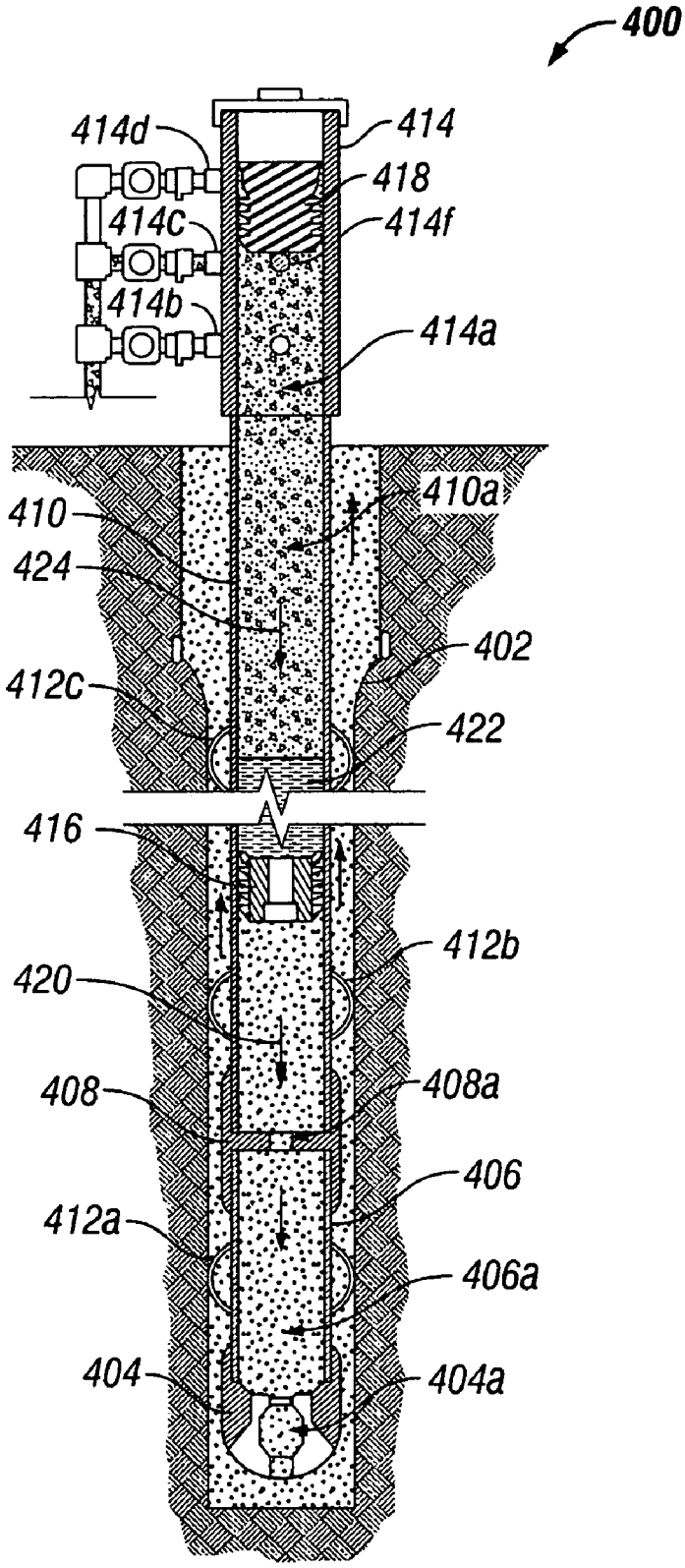

As illustrated in FIG. 4*b*, the bottom cementing plug 416 is then released and a spacer fluid 422 followed by a cement slurry 424 are injected into the injection assembly 414 through the radial passage 414*c* behind and above the bottom cementing plug.

Figure 4C:
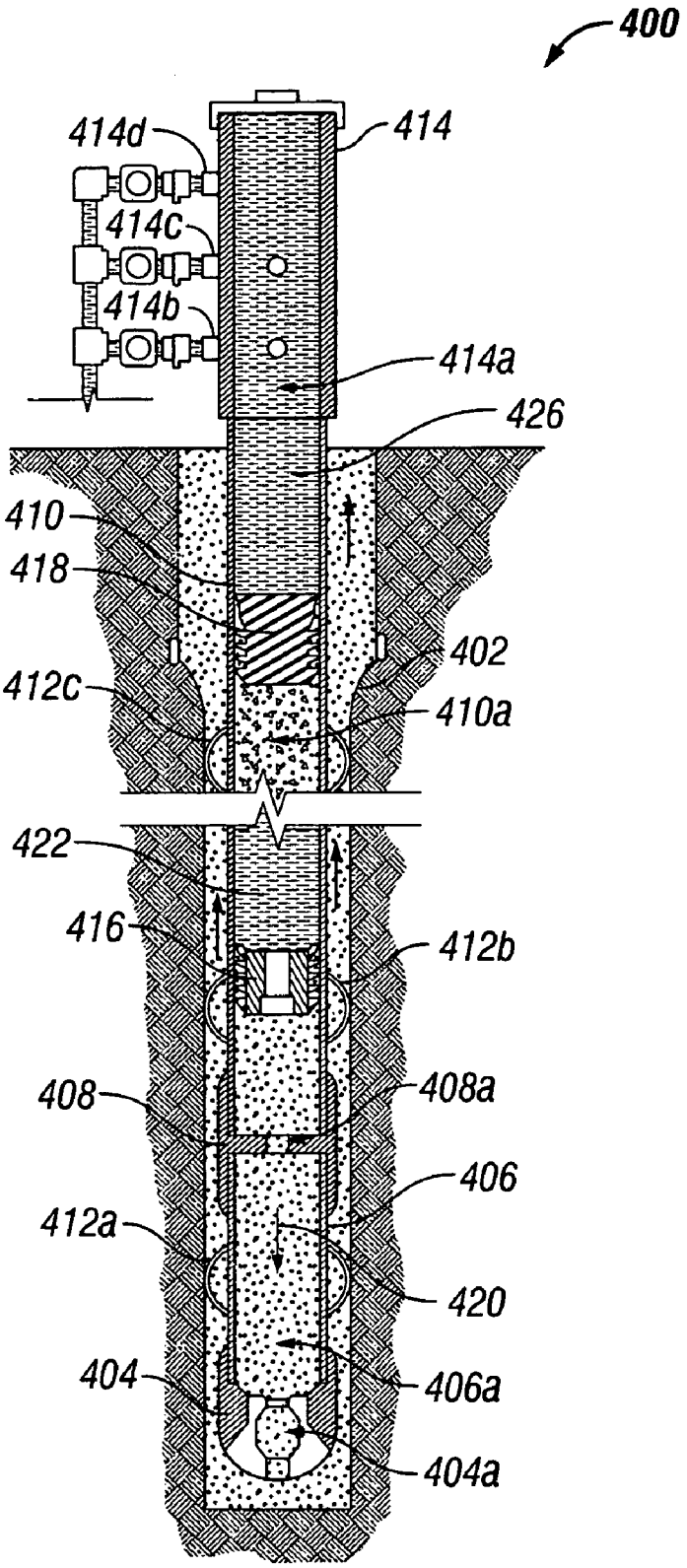

As illustrated in FIG. 4*c*, the top cementing plug 418 is then released and a displacing fluid 426 is injected into the injection assembly 414 through the radial passage 414*d* behind and above the top cementing plug.

Figure 4D:
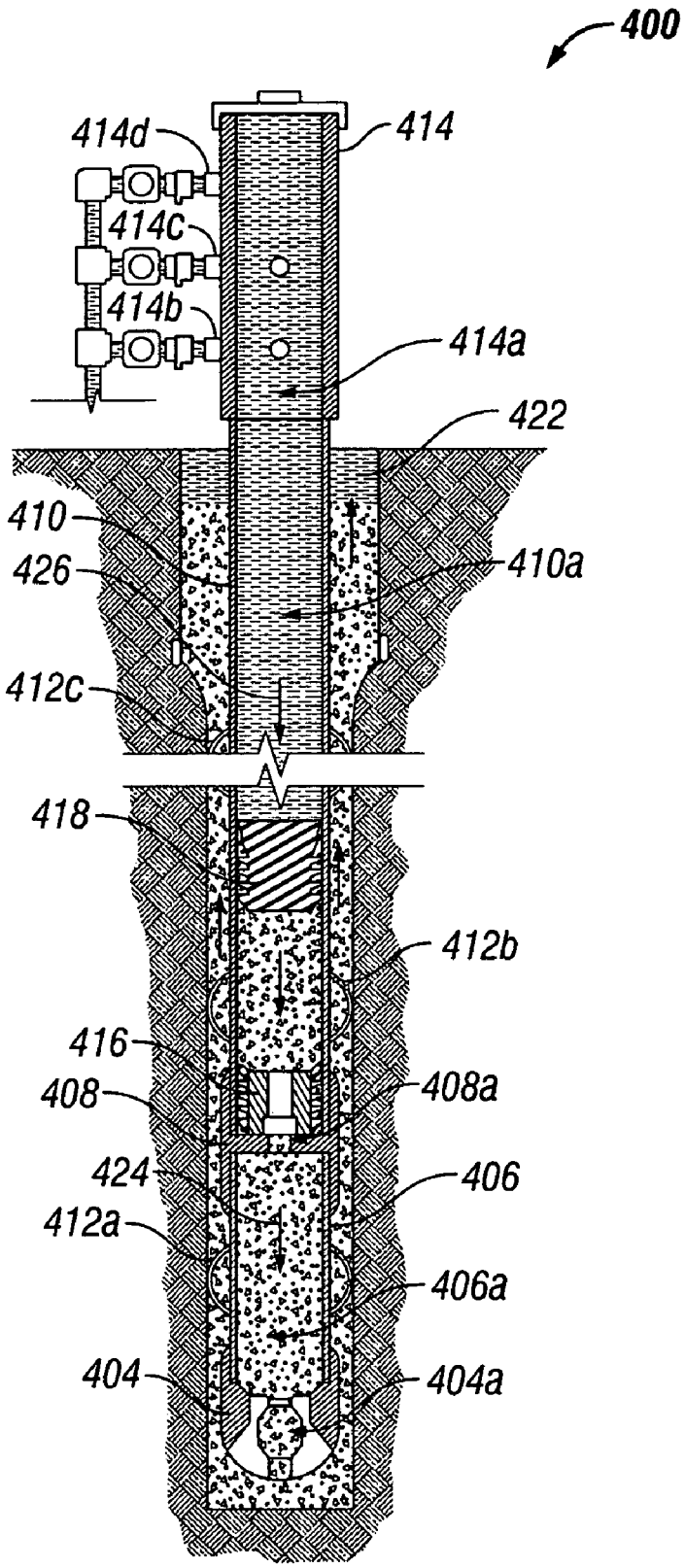

As illustrated in FIG. 4*d*, the continued injection of the displacing fluid 426 further displaces the bottom cementing plug 416 until it impacts and engages the landing collar 408. Further injection of the displacing fluid 426 pressurizes the portion of the passage 410*a* between the top cementing plug 418 and the bottom cementing plug 416 thereby breaking the frangible disc 416*b*. As a result, the cement slurry 424 flows through the passages 416*aa* and 416*ab* of the bottom cementing plug and the passage 408*a* into the annulus between the wellbore 402 and the shoe 404, the tubular member 406, the landing collar 408, and the tubular member 410.

Figure 4E:
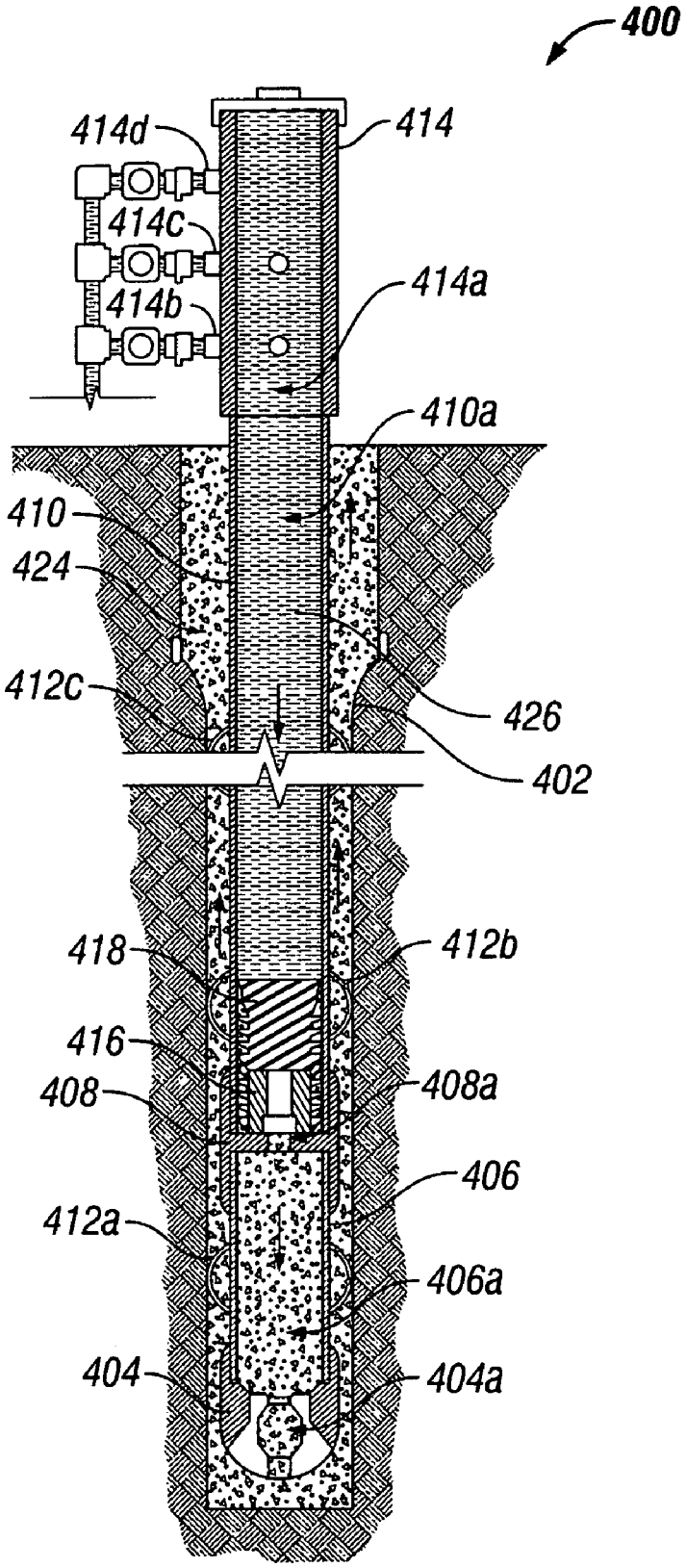

As illustrated in FIG. 4*e*, the continued injection of the displacing fluid 426 then displaces the top cementing plug 418 downwardly until the top cementing plug impacts the bottom cementing plug 416. The flapper check valve 416*c* of the bottom cementing plug 416 prevents back flow of the cement slurry 424 into the tubular member 410. The cement slurry 424 may then be allowed to cure.

The system 400 provides a number of advantages over conventional systems for cementing wellbores. For example, the system 400 eliminates the float collar that is required in conventional systems. As a result, during the operation of the system 400, drilling mud does not have to be circulated through the floating equipment in order to stabilize the wellbore prior to cementing. Furthermore, the system 400 permits a larger internal diameter to be used throughout thereby increasing the operational efficiency. Furthermore, the operational and logistical costs associated with shipping and assembling the float collar, and related equipment, is eliminated by the system 400. In addition, the system 400 reduces restrictions to circulation, reduces surge and swab pressures, reduces fluid losses to the subterranean formation, reduces casing and liner running times, reduces the open hole exposure time, and reduces the loss of valuable drilling fluids to the formation.

In an alternative embodiment, the shoe 404 and the tubular member 406 may be omitted.

Figure 6:
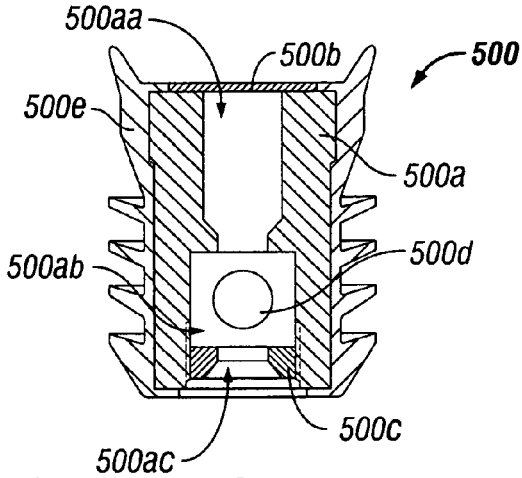
FIG. 6 is a cross-sectional illustrations of an embodiment of a bottom cementing plug for use in the system of FIGS. 4*a*–4*e*.

Referring to FIG. 6, an alternative embodiment of a bottom cementing plug 500 includes a tubular body 500*a* defining a passage 500*aa*, a passage 500*ab*, and a passage 500*ac*. A frangible disc 500*b* is coupled to an end of the tubular body 500*a* to seal off an end of the passage 500*aa*. A ball valve retaining member 500*c* is coupled to the other end of the tubular body 500*a* within the passage 500*ac*. A ball valve 500*d* is positioned within the passage 500*ab* for preventing the flow of fluidic materials from the passage 500*ab* into the passage 500*aa*. A resilient tubular sealing member 500*e* is coupled to the exterior of the tubular body 500*a* for sealing the interface between the bottom cementing plug 500 and a tubular member. During operation, the ball valve 500*d* permits fluidic materials to pass from the passage 500*aa* into the passage 500*ac* but prevents the flow of fluidic materials from the passage 500*ac* into the passage 500*aa*.

Figure 7:
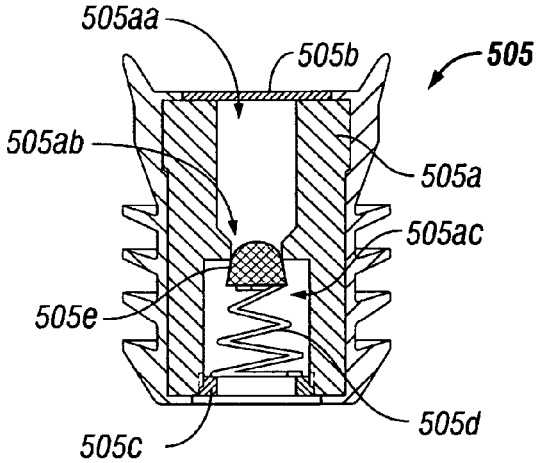
FIG. 7 is a cross-sectional illustrations of an embodiment of a bottom cementing plug for use in the system of FIGS. 4*a*–4*e*.

Referring to FIG. 7, an alternative embodiment of a bottom cementing plug 505 includes a tubular body 505*a* defining a passage 505*aa*, a throat passage 505*ab*, and a passage 505*ac*. A frangible disc 505*b* is coupled to an end of the tubular body 505*a* to seal off an end of the passage 505*aa*. A tubular check valve retaining member 505*c* is coupled to the other end of the tubular body 505*a* within the passage 505*ac*. A spring 505*d* and a dart check valve 505*e* are positioned within the passage 505*ac* for preventing the flow of fluidic materials from the passage 500*ac* into the passage 505*aa*. A resilient tubular sealing member 505*f* is coupled to the exterior of the tubular body 505*a* for sealing the interface between the bottom cementing plug 505 and a tubular member. During operation, the dart check valve 505*e* permits fluidic materials to pass from the passage 505*aa* into the passage 505*ac* but prevents the flow of fluidic materials from the passage 505*ac* into the passage 505*aa*.

In several alternative embodiments, the system 400 utilizes the bottom cementing plugs 500 or 505 in place of the bottom cement plug 416 in order to prevent the back flow of the cement slurry 424 into the tubular member 410.

Referring to FIGS. 8*a*–8*f*, an alternative embodiment of a system 600 for cementing a wellbore 602 having a preexisting wellbore casing 604 includes a shoe 606 defining a passage 606*a* that is coupled to an end of a tubular member 608 defining a passage 608*a*. The other end of the tubular member 608 is coupled to an end of a landing collar 610 defining a passage 610*a*. The other end of the landing collar 610 is coupled to an end of a tubular member 612 defining a passage 612*a*. A liner hanger 613 is coupled to the exterior of the tubular member 612 for coupling the tubular member 612 to the preexisting wellbore casing 604. A centralizer 614 may be coupled to the exterior of the tubular member 612 for centrally positioning the tubular member inside the preexisting wellbore casing 604. An end of a tubular support member 616 defining a passage 616*a* extends into the other end of the tubular member 612. A releasable coupling 618 is coupled to the tubular support member 616 for releasably coupling the tubular support member to the tubular member 612. A wiper plug 620 defining a restricted passage 620*a* is releasably coupled to an end of the tubular support member 616 within the other end of the tubular member 612, and a bottom cementing plug 622 is releasably coupled to and end of the wiper plug 620 within the tubular member. A bumper 624 and a cup seal 626 are coupled to the exterior of the end of the tubular support member 616 within the tubular member 612.

Figure 9A:
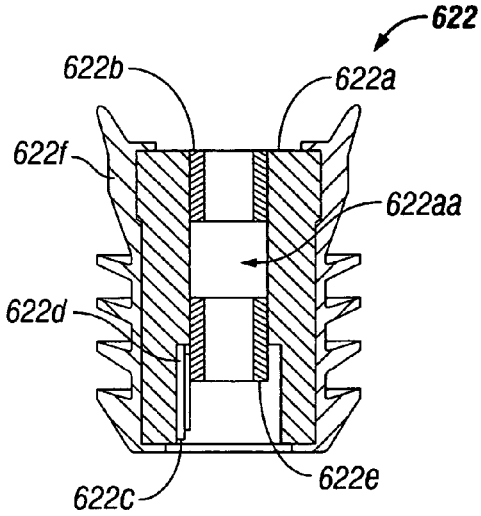
FIG. 9*a* is a cross-sectional illustration of an embodiment of a bottom cementing plug for use in the system of FIGS. 8*a*–8*f* in an initial operational position.

As illustrated in FIG. 9*a*, in an exemplary embodiment, the bottom cementing plug 622 includes a tubular body 622*a* defining a passage 622*aa* and a passage 622*ab*. A frangible tubular ball seat 622*b* is positioned within, and coupled to, the interior surface of an end of the passage 622*aa* aa for receiving a conventional ball. A flapper check valve 622*c* is positioned within, and pivotally coupled to, the interior surface of the passage 622*ab* by a pivot support 622*d* for controllably for preventing the flow of fluidic materials from the passage 622*ab* into the passage 622*aa*. In an exemplary embodiment, the flapper check valve 622*c* is resiliently biased to pivot about the pivot support 622*d* and thereby close off the passage 622*aa*. An end of a frangible tubular retaining member 622*e* is positioned within, and coupled to, the passage 622*aa*. The other end of the frangible tubular retaining member 622*e* extends into the passage 622*ab* for preventing the flapper check valve 622*c* from pivoting to seal off the passage 622*aa*. A resilient tubular sealing member 622*f* is coupled to the exterior of the tubular body 622*a* for sealing the interface between the bottom cementing plug 622 and the tubular member 612. During operation, after the frangible tubular retaining member 622*e* has been removed, the flapper check valve 622*c* permits fluidic materials to flow from the passage 622*aa* into the passage 622*ab*, and prevents fluidic materials from flowing from the passage 622*ab* into the passage 622*aa*.

Figure 8A:
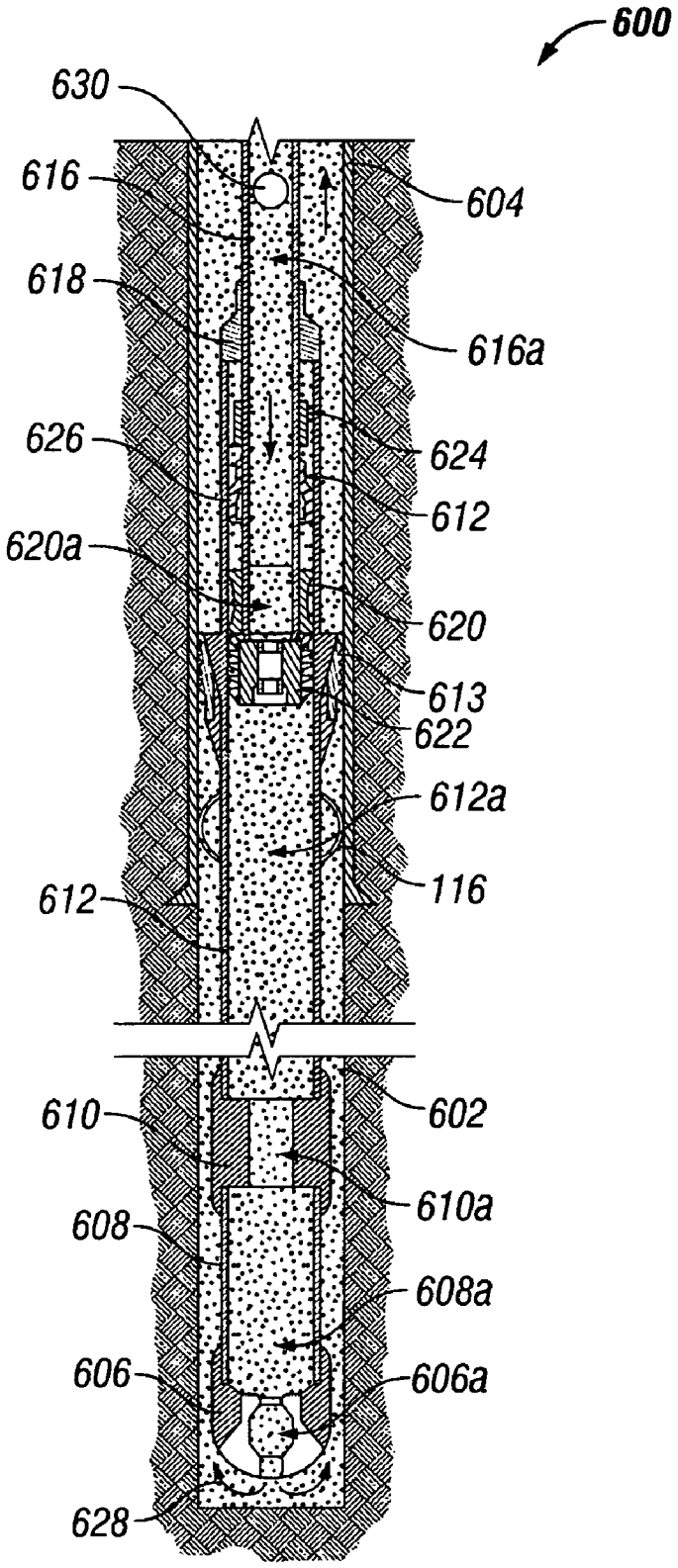
FIGS. 8*a*–8*f* are fragmentary cross-sectional illustrations of an embodiment of a system for cementing a wellbore.

During operation, as illustrated in FIG. 8*a*, drilling mud 628 is circulated through the wellbore 602 by injecting the drilling mud through the passages 616*a*, 620*a*, 612*a*, the bottom cementing plug 626, the passages 610*a*, 608*a*, and 606*a* into the annulus between the shoe 606, the tubular member 608, the landing collar 610, and the tubular member 612. A ball 630 is introduced into the injected drilling mud 628 for reasons to be described.

Figure 8B:
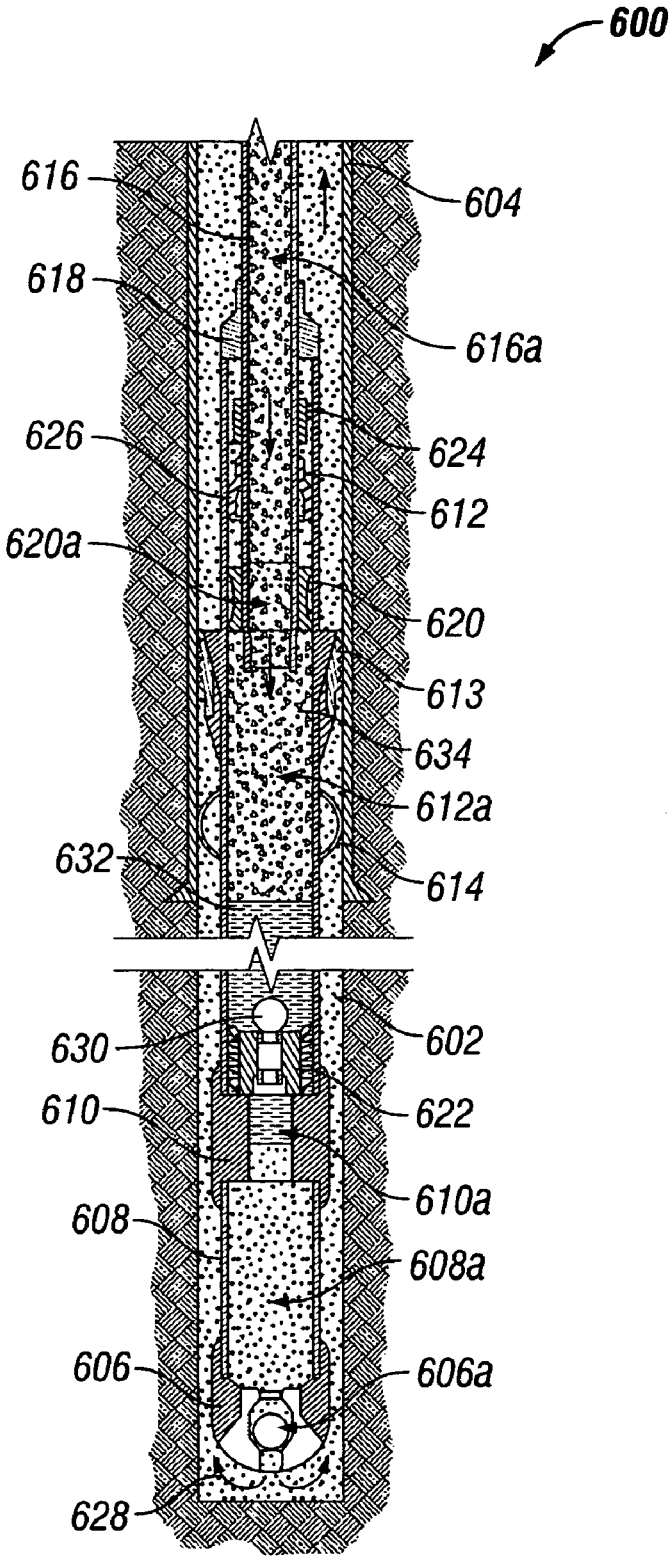

As illustrated in FIG. 8*b*, a spacer fluid 632 followed by a cement slurry 634 are then injected into the passages 616*a*, 620*a*, and 612*a* behind and above the drilling mud 628. The ball 630 impacts and mates with the ball seat 622*b* of the bottom cementing plug 622 and decouples the bottom cementing plug from engagement with the wiper plug 620. As a result, the bottom cementing plug 622 is displaced downwardly in the tubular member 612 and impacts and engages the landing collar 610.

Figure 8C:
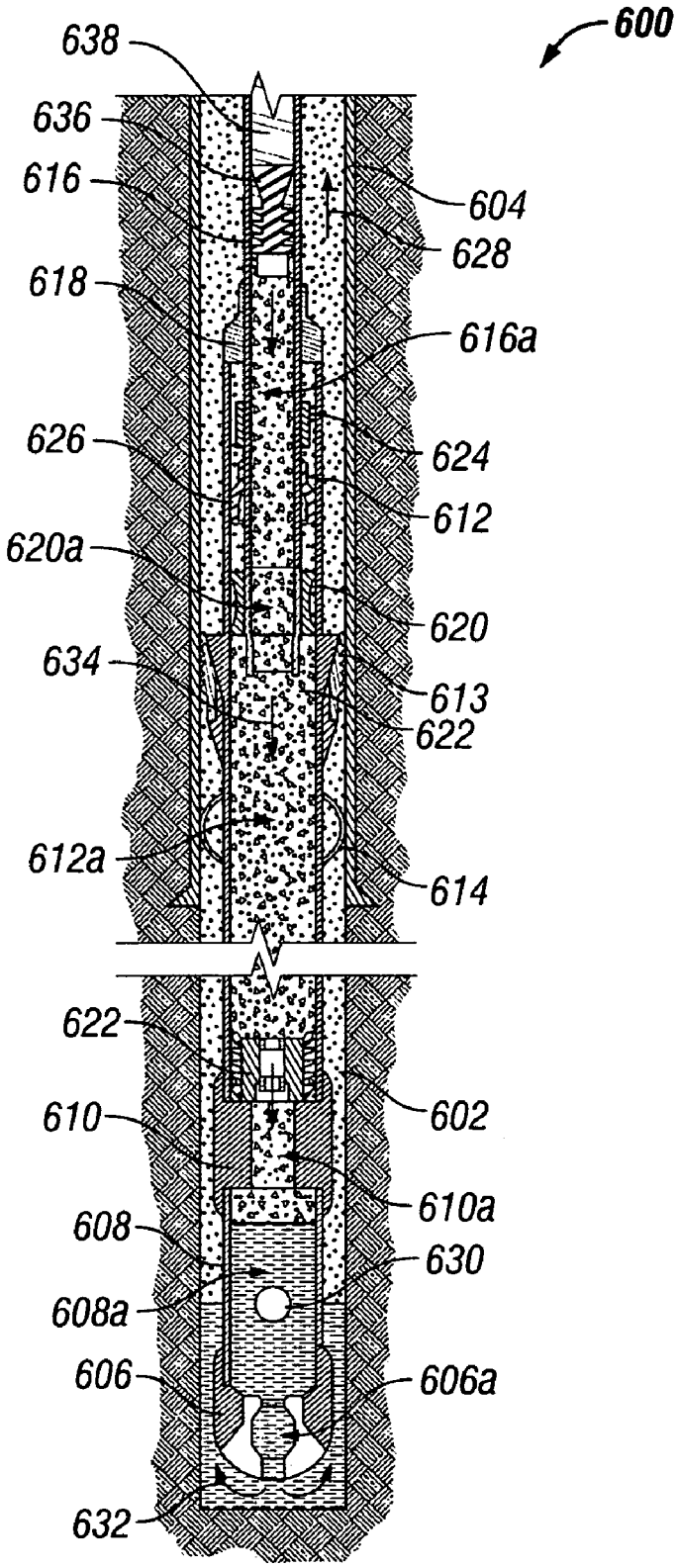
Figure 9B:
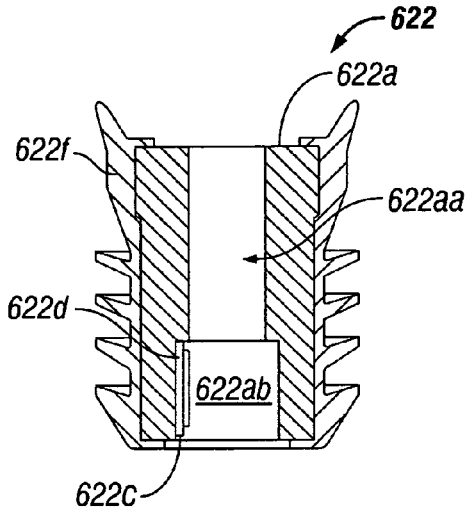
FIG. 9*b* is an illustration of bottom cementing plug of FIG. 9*a* after removing the ball seat and flapper valve retainer.

As illustrated in FIG. 8*c*, a pump down plug 636 is then injected into the passage 616*a* followed by a displacing fluid 638. The continued injection of the displacing fluid 638 pressurizes the portion of the passage 612*a* above the bottom cementing plug 622 and ball 630. As a result, the ball 630 breaks through and removes the frangible ball seat 622*b* and the retaining member 622*e* of the bottom cementing plug 622 and into the passage 608*a* thereby permitting fluidic materials to pass from the passage 612*a*, through the passages 622*aa* and 622*ab* of the bottom cementing plug 622, and into the passage 608*a*. As a result, as illustrated in FIG. 9*b*, the flapper valve 622*c* is no longer prevented from pivoting to close off the passage 622*a*.

Figure 8D:
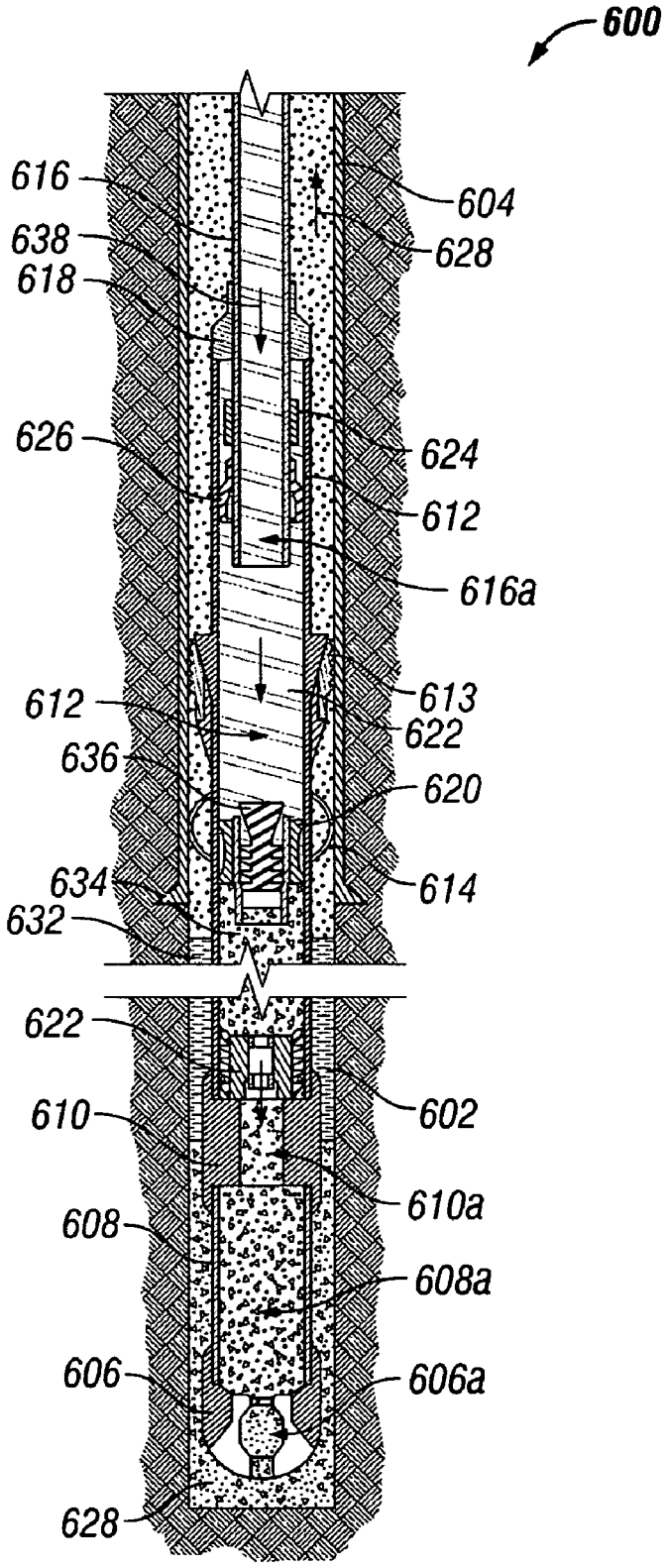

As illustrated in FIG. 8*d*, the continued injection of the displacing fluid 638, causes the pump down plug 636 to engage the restricted passage 620*a* of the wiper plug 620 thereby disengaging the wiper plug from the end of the tubular support member 616. As a result, the wiper plug 620 and the pump down plug 636 are driven downwardly within the tubular member 612 by the continued injection of the displacing fluid 638 which in turn displaces the spacer fluid 632 and the cement slurry 634 through the passages, 622*aa* and 622*ab*, of the bottom cementing plug 626, through the passages, 610*a*, 608*a*, and 606*a*, into the annulus between the wellbore 602 and the shoe 606, the tubular member 608, the landing collar 610 and the tubular member.

Figure 8E:
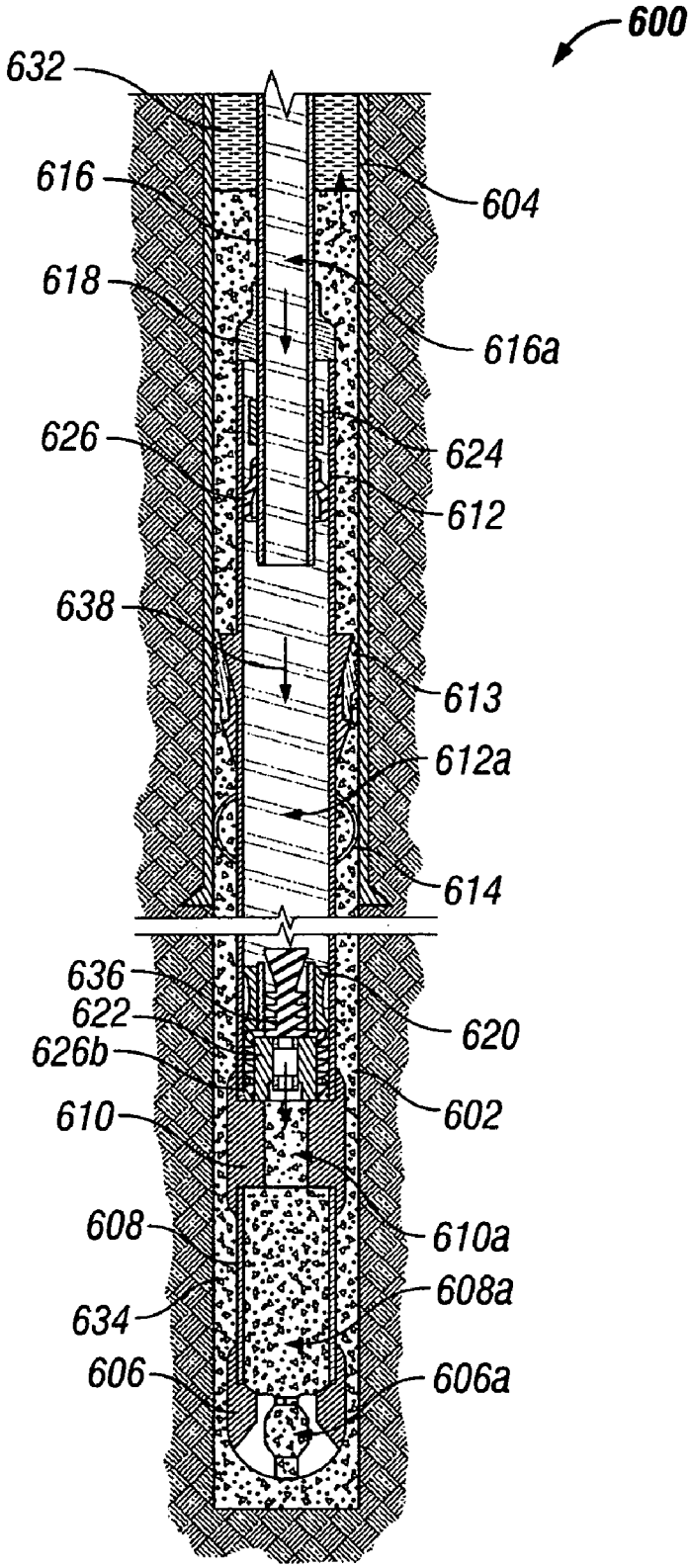
Figure 9C:
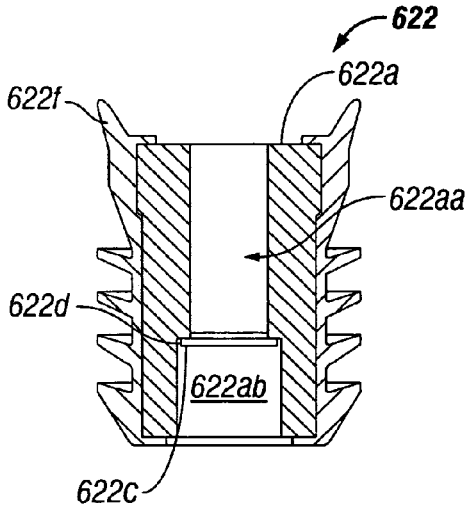
FIG. 9*c* is an illustration of bottom cementing plug of FIG. 9*b* after rotating the flapper valve to the closed position.

As illustrated in FIG. 8*e*, the continued injection of the displacing fluid 638 causes the wiper plug 620 and the pump down plug 636 to impact and engage the bottom cementing plug 622 and fills the annulus between the wellbore 602 and the tubular member 612 with the cement slurry 634. The backpressure created by the injected cement slurry 634 then causes the flapper valve 622*c* to pivot and thereby close off the passage 622*aa* as illustrated in FIGS. 8*e* and 9*c*. As a result, the back flow of the cement slurry 634 from the passage 608*a* into the passage 612*a* is prevented.

Figure 8F:
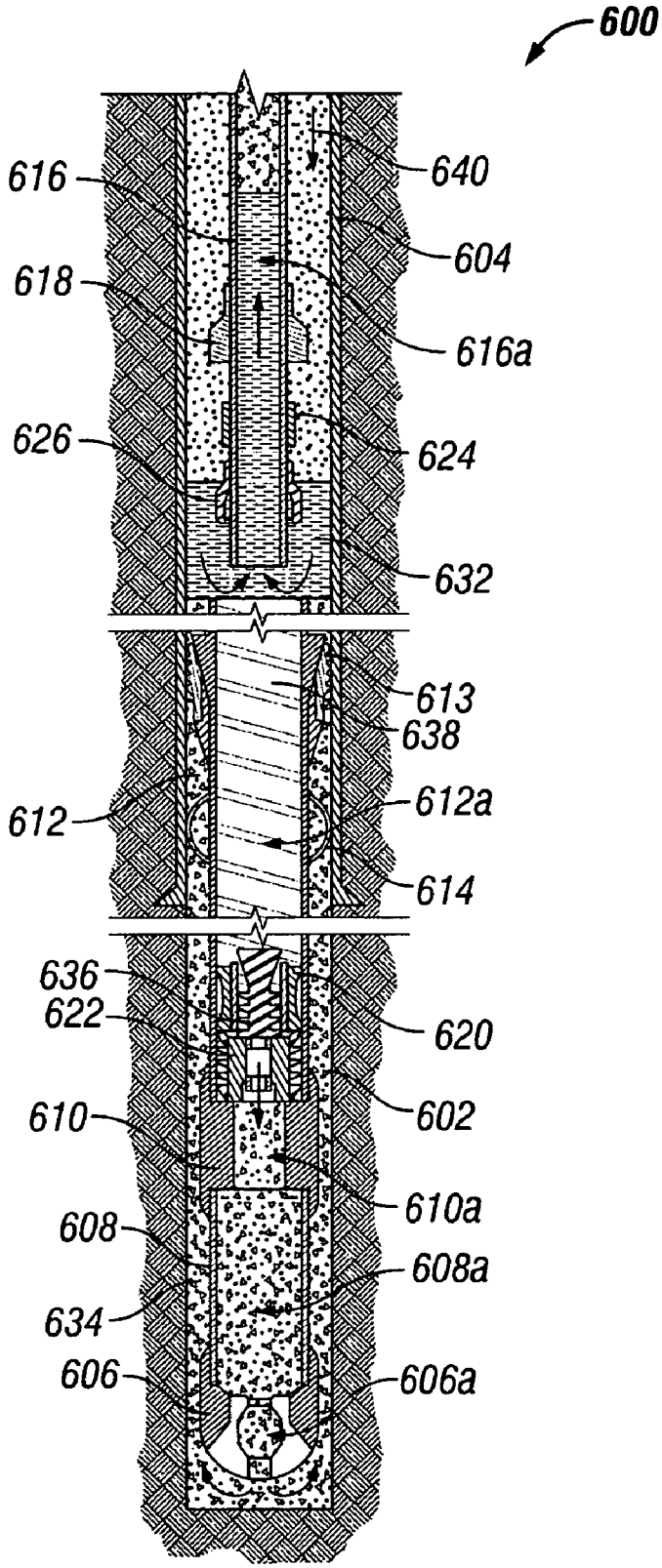

As illustrated in FIG. 8*f*, the tubular support member 616 is then decoupled from the tubular member 612 and raised out of the tubular member 612. The spacer fluid 632 and cement slurry 634 above the tubular member 612 may then be removed by circulating drilling mud 640 through the annulus between the tubular support member 616 and the preexisting wellbore casing 604. The cement slurry 634 may then be allowed to cure.

The system 600 provides a number of advantages over conventional systems for cementing wellbores. For example, the system 600 eliminates the float shoe that is required in conventional systems. As a result, during the operation of the system 600, drilling mud does not have to be circulated through the floating equipment in order to stabilize the wellbore prior to cementing. Furthermore, the system 600 permits a larger internal diameter to be used throughout thereby increasing the operational efficiency. Furthermore, the operational and logistical costs associated with shipping and assembling the float collar, and related equipment, is eliminated by the system 600. In addition, the system 600 reduces restrictions to circulation, reduces surge and swab pressures, reduces fluid losses to the subterranean formation, reduces casing and liner running times, reduces the open hole exposure time, and reduces the loss of valuable drilling fluids to the formation.

In an alternative embodiment, the shoe 606 and the tubular member 608 may be omitted from the system 600.

Figure 9D:
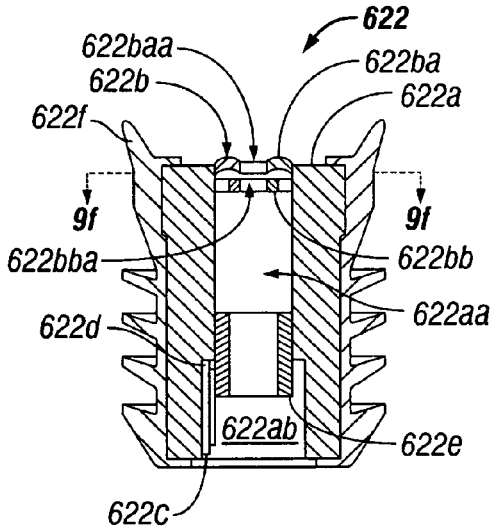
FIG. 9*d* is an illustration of an alternative embodiment of the bottom cementing plug of FIG. 9*a*.
Figure 9E:
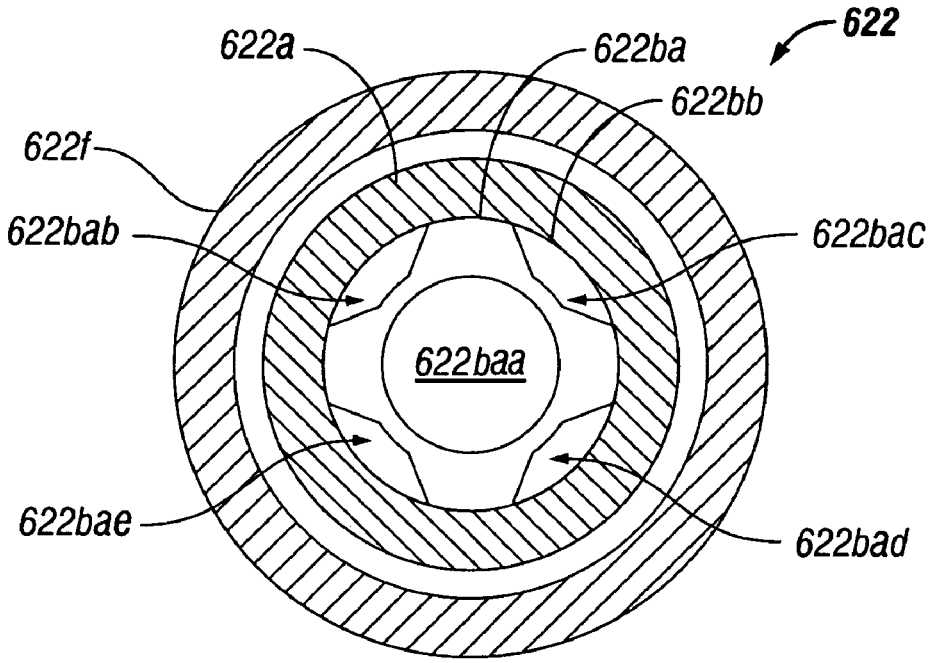
FIG. 9*e* is a top view of the bottom cementing plug of FIG. 9*d*.
Figure 9F:
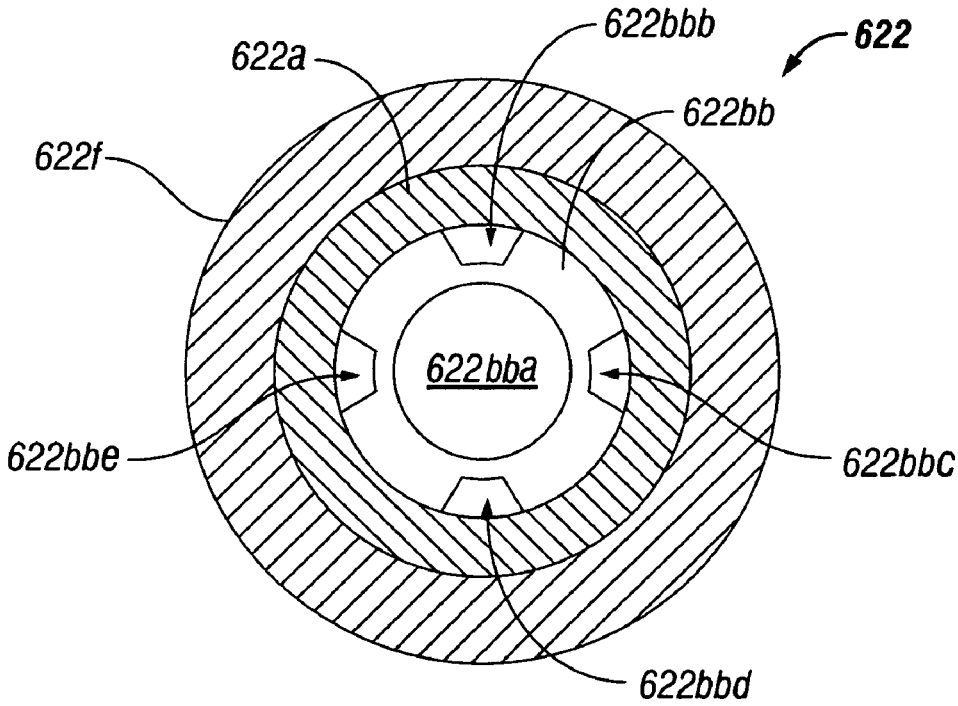
FIG. 9*f* is a cross sectional illustration of the bottom cementing plug of FIG. 9*d*.

In an alternative embodiment of the bottom cementing plug 622, as illustrated in FIGS. 9*d*, 9*e*, and 9*f*, the frangible tubular ball seat 622*b* includes a frangible upper tubular ball seat 622*ba* and a lower frangible tubular member 622*bb* that are positioned within, and releasably coupled to, the end of the passage 622*aa*. The frangible upper tubular ball seat 622*ba* is fabricated from a resilient and frangible material and defines a central passage 622*baa* and a plurality of auxiliary passages, 622*bab*, 622*bac*, 622*bad*, and 622*bae*. The frangible lower tubular member 622*bb* is fabricated from a frangible material and defines a central passage 622*bba* and a plurality of auxiliary passages, 622*bbb*, 622*bbc*, 622*bbd*, and 622*bbe*. In an exemplary embodiment, the auxiliary passages 622*bab*, 622*bac*, 622*bad*, and 622*bae* are interleaved with the auxiliary passages 622*bbb*, 622*bbc*,

622*bbd*, and 622*bbe*. Furthermore, in an initial position, at least a portion of the frangible upper tubular ball seat 622*ba* is spaced apart from the frangible lower tubular member 622*bb*. In this manner, in the initial position, fluidic materials may pass through the passages 622*baa* and 622*bba* and a serpentine path defined by the auxiliary passages 622*bab*, 622*bac*, 622*bad*, and 622*bae* and the auxiliary passages 622*bbb*, 622*bbc*, 622*bbd*, and 622*bbe*. In this manner, in the initial position, the volumetric rate of flow of the fluidic materials through the bottom cementing plug 622 is enhanced.

In a compressed position, such as, for example, when the ball 630 impacts and mates with the frangible tubular ball seat 622*ba*, the tubular ball seat 622*ba* is compressed into contact with the frangible lower tubular member 622*bb*. As a result, the passages 622*baa* and 622*bba* are sealed off by the ball 630, and the serpentine path defined by the auxiliary passages 622*bab*, 622*bac*, 622*bad*, and 622*bae* and the auxiliary passages 622*bbb*, 622*bbc*, 622*bbd*, and 622*bbe* is closed off.

Referring to FIGS. 10*a*–10*e*, an alternative embodiment of a system 700 for cementing a wellbore 702 having a preexisting wellbore casing 704 includes a shoe 706 defining a passage 706*a* that is coupled to an end of a tubular member 708 defining a passage 708*a*. The other end of the tubular member 708 is coupled to an end of a landing collar 710 defining a passage 710*a*. The other end of the landing collar 710 is coupled to an end of a tubular member 712 defining a passage 712*a*. A centralizer 714 may be coupled to the exterior of the tubular member 712 for centrally positioning the tubular member inside the preexisting wellbore casing 704. An end of a tubular support member 716 defining a passage 716*a* extends into the other end of the tubular member 712. A releasable coupling 718 is coupled to the tubular support member 716 for releasably coupling the tubular support member to the tubular member 712. A wiper plug 720 defining a restricted passage 720*a* is coupled to an end of the tubular support member 716 within the other end of the tubular member 712. The bottom cementing plug 622 is releasably coupled to an end of the wiper plug 720 and positioned within the passage 712*a*. A bumper 724 and a cup seal 726 are coupled to the exterior of the end of the tubular support member 716 within the tubular member 712.

Figure 10A:
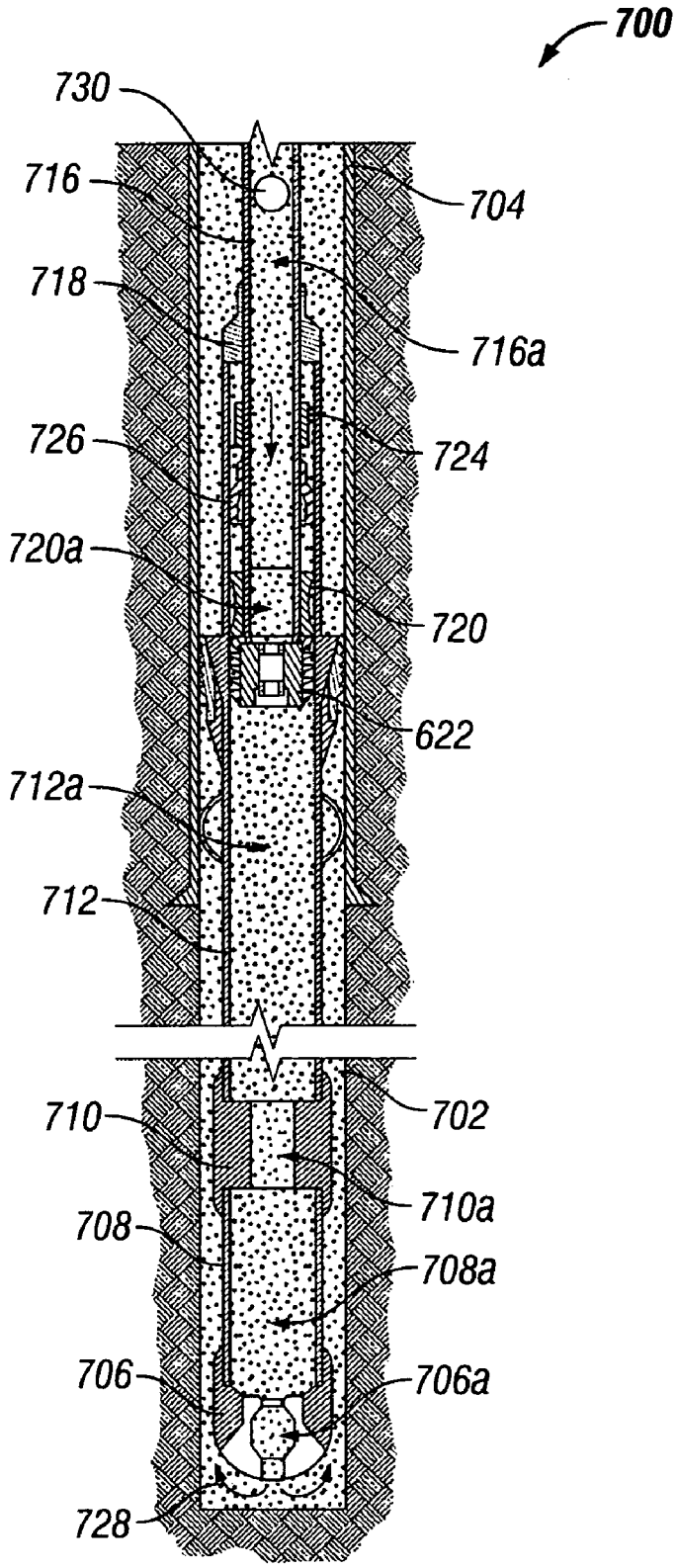
FIGS. 10*a*–10*e* are fragmentary cross-sectional illustrations of an embodiment of a system for cementing a wellbore.

During operation, as illustrated in FIG. 10*a*, drilling mud 728 is circulated through the wellbore 702 by injecting the drilling mud through the passages 716*a*, 720*a*, 712*a*, the bottom cementing plug 726, the passages 710*a*, 708*a*, and 706*a* into the annulus between the shoe 706, the tubular member 708, the landing collar 710, and the tubular member 712. A ball 730 is also injected into the passage 716*a* with the injected drilling mud 728 for reasons to be described.

Figure 10B:
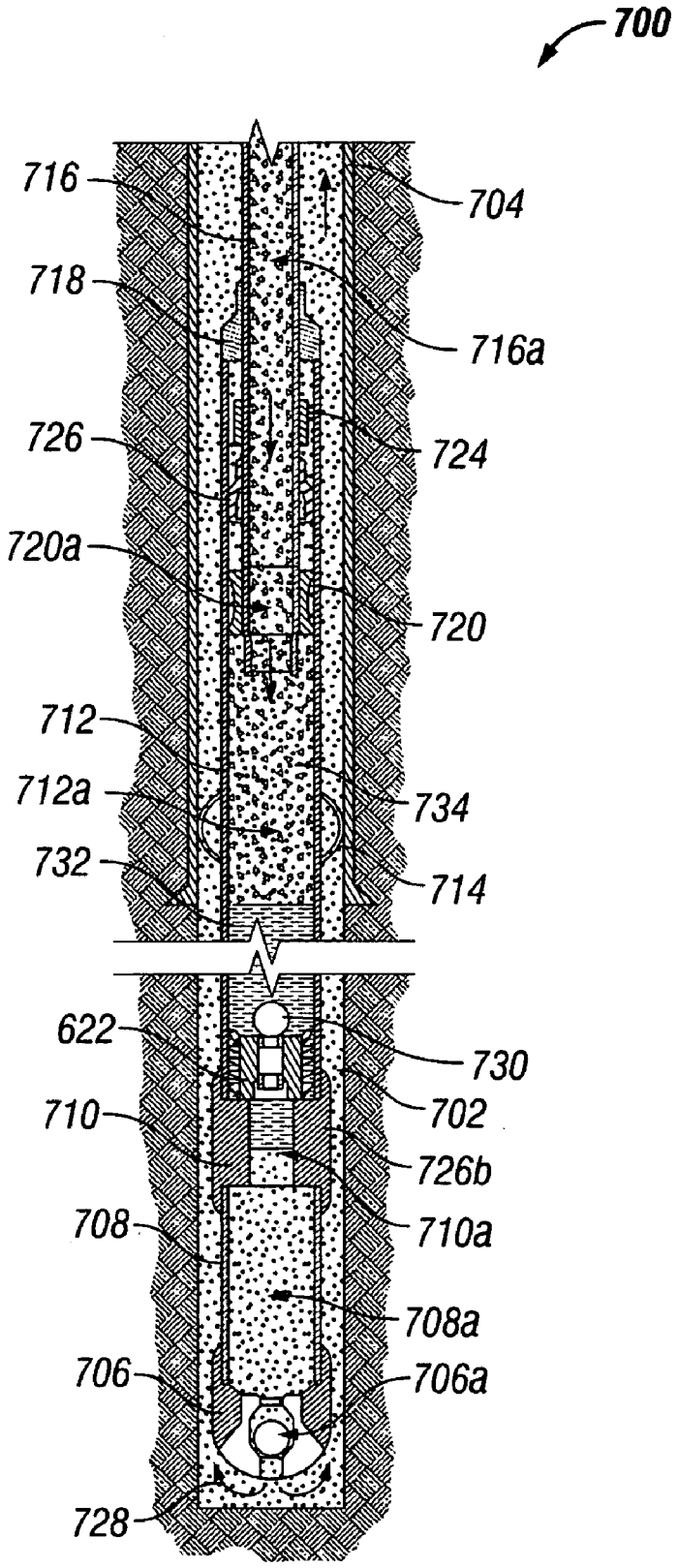

As illustrated in FIG. 10*b*, a spacer fluid 732 followed by a cement slurry 734 are then injected into the passages 716*a*, 720*a*, and 712*a* behind and above the drilling mud 728. The ball 730 impacts and mates with the ball seat 722*b* of the bottom cementing plug 622 and decouples the bottom cementing plug from engagement with the wiper plug 720. As a result, the bottom cementing plug 622 is displaced downwardly in the tubular member 712 and impacts the landing collar 710.

Figure 10C:
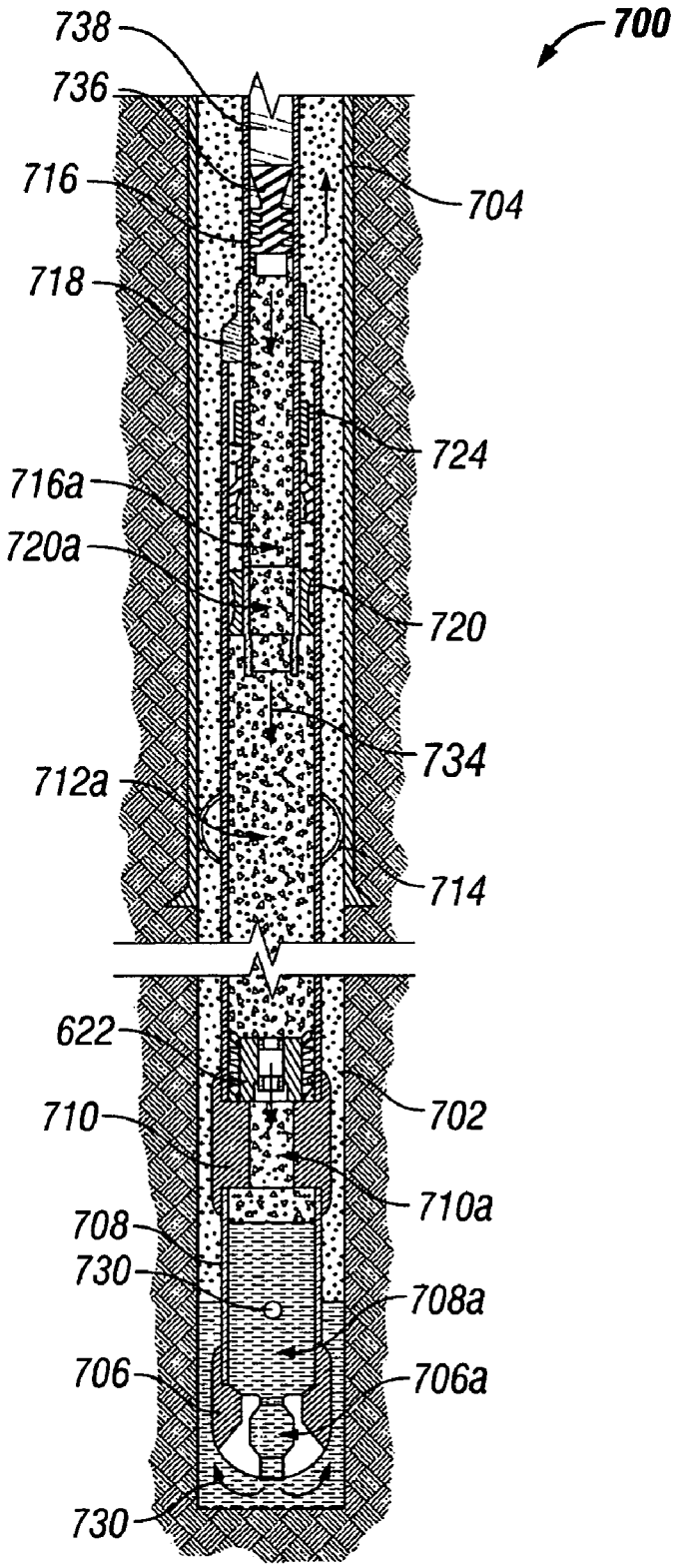

As illustrated in FIG. 10*c*, a pump down plug 736 is then injected into the passage 716*a* followed by a displacing fluid 738. The continued injection of the displacing fluid 738 pressurizes the portion of the passage 712*a* above the bottom cementing plug 622 and the ball 730. As a result, the ball 730 breaks through and removes the frangible tubular ball seat 622*b* and tubular retaining member 622*e* of the bottom cementing plug 622 thereby permitting fluidic materials to pass through the passage 622*aa* and 622*ab* of the bottom cementing plug.

Figure 10D:
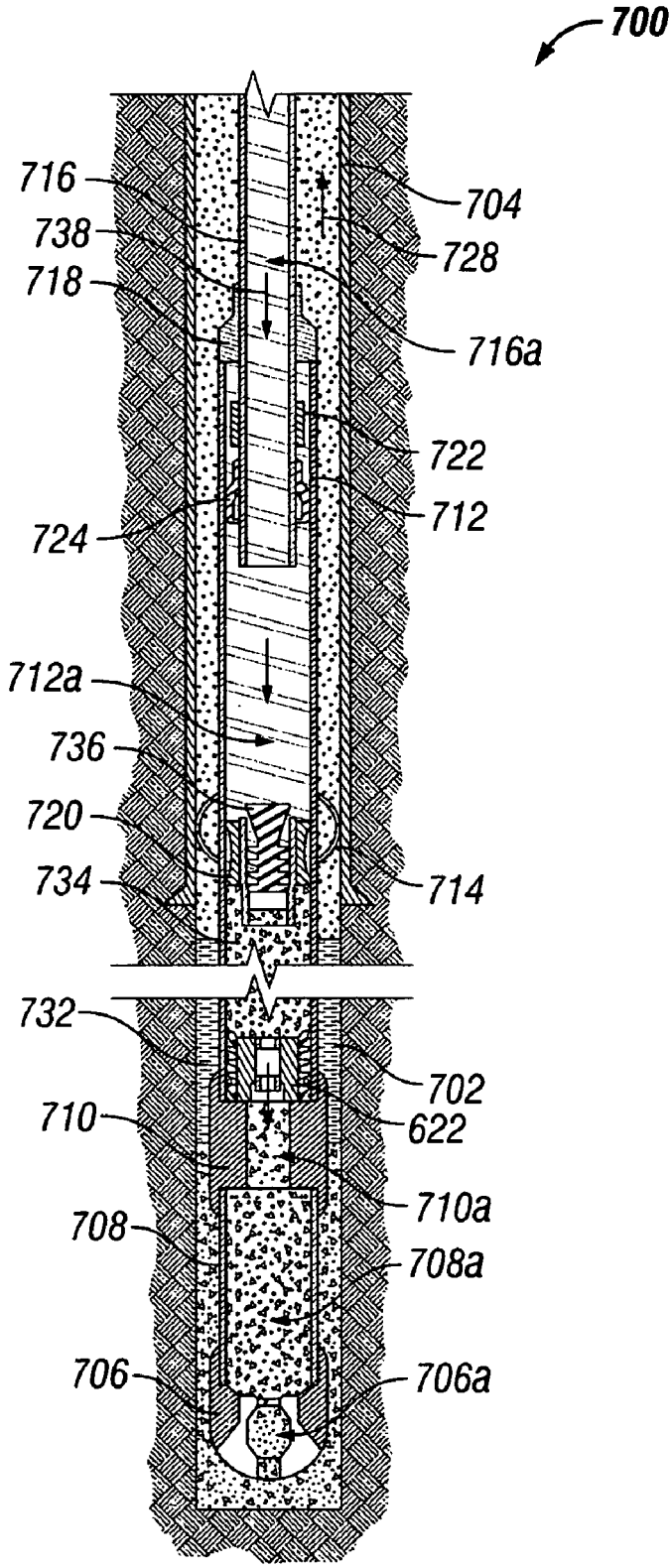

As illustrated in FIG. 10*d*, the continued injection of the displacing fluid 738, causes the pump down plug 736 to engage the restricted passage 720*a* of the wiper plug 720 thereby disengaging the wiper plug from the end of the tubular support member 716. As a result, the wiper plug 720 and the pump down plug 736 are driven downwardly within the tubular member 712 by the continued injection of the displacing fluid 738 which in turn displaces the spacer fluid 732 and the cement slurry 734 through the bottom cementing plug 622 and the passages, 710*a*, 708*a*, and 706*a*, into the annulus between the wellbore 702 and the shoe 706, the tubular member 708, the landing collar 710 and the tubular member.

Figure 10E:
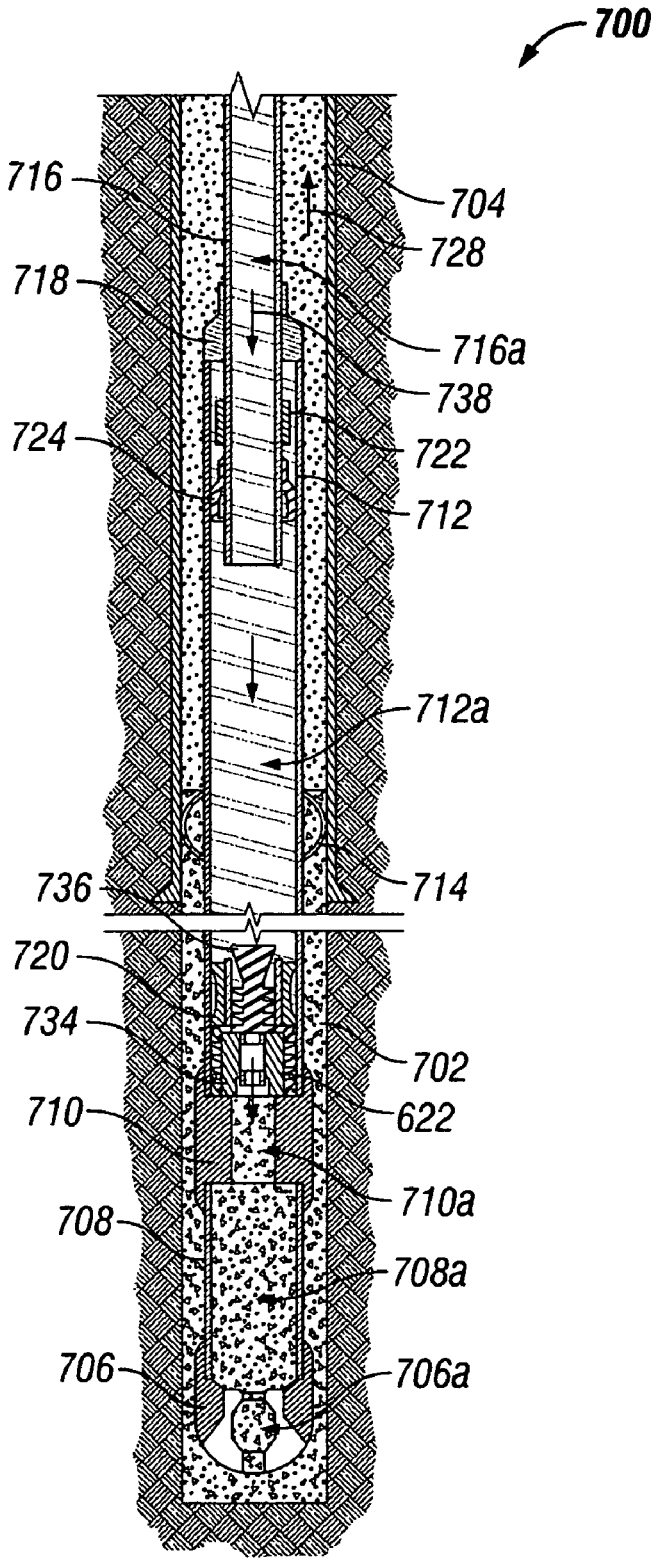

As illustrated in FIG. 10*e*, the continued injection of the displacing fluid 736 causes the wiper plug 720 and the pump down plug 734 to impact and engage the bottom cementing plug 622 and fills the annulus between the wellbore 702 and the tubular member 712 with the cement slurry 734. The back pressure created by the cement slurry 734 pivots the flapper valve 622*c* of the bottom cementing plug 622 to close off the passage 622*aa* thereby preventing back flow of the cement slurry from the passage 708*a* into the passage 712*a*.

The tubular support member 716 may then be decoupled from the tubular member 712 and raised out of the tubular member 712. The spacer fluid 730 and cement slurry 732 above the tubular member 712 may then be removed by circulating drilling mud through the annulus between the tubular support member 716 and the preexisting wellbore casing 704. The cement slurry 732 may then be allowed to cure.

The system 700 provides a number of advantages over conventional systems for cementing wellbores. For example, the system 700 eliminates the float shoe that is required in conventional systems. As a result, during the operation of the system 700, drilling mud does not have to be circulated through the floating equipment in order to stabilize the wellbore prior to cementing. Furthermore, the system 700 permits a larger internal diameter to be used throughout thereby increasing the operational efficiency. Furthermore, the operational and logistical costs associated with shipping and assembling the float collar, and related equipment, is eliminated by the system 700. In addition, the system 700 reduces restrictions to circulation, reduces surge and swab pressures, reduces fluid losses to the subterranean formation, reduces casing and liner running times, reduces the open hole exposure time, and reduces the loss of valuable drilling fluids to the formation.

In an alternative embodiment, the shoe 706 and the tubular member 708 may be omitted from the system 700.

It is understood that variations may be made in the foregoing without departing from the scope of the invention. For example, the present systems for cementing a wellbore can be utilized to provide an annular layer of cement around a pipeline or a structural support. Furthermore, in several alternative embodiments, the landing collars, 408, 610, and 710, of the systems, 400, 600 and 700, include conventional anti-rotational locking devices and/or latching devices that further restrain the movement of the bottom cementing plugs, 416 and 622 after they engage the landing collars thereby improving the hydraulic seal between the bottom cementing plugs and the landing collars.

Although illustrative embodiments of the invention have been shown and described, a wide range of modification, changes and substitution is contemplated in the foregoing disclosure. In some instances, some features of the present invention may be employed without a corresponding use of the other features. Accordingly, it is appropriate that the appended claims be construed broadly and in a manner consistent with the scope of the invention.

What is claimed is:

1. An apparatus for cementing an annulus between a tubular liner and a wellbore including a preexisting wellbore casing, comprising:

a tubular support member;

a wiper plug releasably coupled to an end of the tubular support member;

a tubular liner releasably coupled to the tubular support member;

a landing collar defining a restricted passage coupled to an end of the tubular liner;

a cementing plug for sealingly engaging the tubular liner and releasably coupled to the wiper plug, comprising:

a plug body defining a plug passage;

a valve for controlling the back flow of fluidic materials through the plug passage; and a fluid injection assembly coupled to the tubular support member for injecting fluidic materials into the tubular support member and controllably releasing a ball and a pump down plug into the tubular support member for engaging the cementing plug and the wiper plug.

2. The apparatus of claim 1, further comprising: a liner hanger coupled to the tubular liner for coupling the tubular liner to the preexisting wellbore casing.

3. The apparatus of claim 1, wherein the valve comprises a one-way valve.

4. The apparatus of claim 1, wherein the valve comprises a flapper valve.

5. The apparatus of claim 1, wherein the cementing plug further comprises: a frangible member for preventing the operation of the valve.

6. The apparatus of claim 1, wherein the cementing plug further comprises: a frangible seat for mating with a ball.

7. The apparatus of claim 6, wherein the frangible seat comprises: an upper frangible and resilient membrane defining an upper central passage and one or more upper peripheral passages; and a lower frangible membrane defining a lower central passage and one or more lower peripheral passages.

8. The apparatus of claim 7, wherein the upper peripheral passages and the lower peripheral passages are interleaved.

9. A method of cementing an annulus between a tubular liner and a wellbore including a preexisting wellbore casing, comprising:

releasably supporting a tubular liner defining a passage and including a landing collar at one end defining a restricted passage within the wellbore using a tubular support member defining a passage fluidicly coupled to the passage of the tubular liner and including a wiper plug releasably coupled to an end of the tubular support member;

releasably coupling a cementing plug to the wiper plug within the tubular member, the cementing plug comprising:

a plug body defining a plug passage; and a one way valve for controlling the flow of fluidic materials through the plug passage;

injecting a non-hardenable fluidic material into the passage of the tubular support member;

injecting a ball into the passage of the tubular support member;

injecting a hardenable fluidic sealing material into the passage of the tubular support member; the ball decoupling the cementing plug from the wiper plug; the cementing plug engaging the landing collar;

injecting a pump down plug into the passage of the tubular support member;

injecting a non-hardenable fluidic material into the passage of the tubular support member; and decoupling the wiper plug from the end of the tubular support member; the wiper plug and the pump down plug engaging the cementing plug; and the one way valve preventing the hardenable fluidic sealing material from passing back into the tubular liner.

10. The method of claim 9, wherein the one-way valve comprises: a flapper valve.

11. The method of claim 9, wherein the cementing plug further comprises: a frangible member for preventing the operation of the valve.

12. The method of claim 9, wherein the cementing plug further comprises: a frangible seat for mating with a ball.

13. The method of claim 12, wherein the frangible seat comprises:

an upper frangible and resilient membrane defining an upper central passage and one or more upper peripheral passages; and a lower frangible membrane defining a lower central passage and one or more lower peripheral passages.

14. The method of claim 13, wherein the upper peripheral passages and the lower peripheral passages are interleaved.

15. The method of claim 9, further comprising: permitting fluidic materials to pass through a plurality of passages through the cementing plug.

16. The method of claim 15, further comprising: engaging the cementing plug with the ball to seal off the plurality of passages.

17. The method of claim 9, further comprising: coupling the tubular liner to the preexisting wellbore casing.

18. A bottom cementing plug for use in a system for cementing an annulus between a wellbore casing and a wellbore, comprising:

a plug body defining a passage;

a frangible ball seat positioned within one end of the passage;

a one way valve positioned within another end of the passage for controlling the flow of fluidic materials through the passage; and a frangible retaining member positioned within the other end of the passage for retaining the one way valve in a stationary position.

19. The bottom cementing plug of claim 18, wherein the frangible ball seat comprises: a frangible tubular member.

20. The bottom cementing plug of claim 18, wherein the frangible ball seat comprises:

an upper frangible and resilient membrane defining an upper central passage and one or more upper peripheral passages;

and a lower frangible membrane defining a lower central passage and one or more lower peripheral passages.

21. The bottom cementing plug of claim 20, wherein the upper peripheral passages and the lower peripheral passages are interleaved.

* * * * *